US005470078A

United States Patent [19]

Conlan

[11] Patent Number: 5,470,078

[45] Date of Patent: Nov. 28, 1995

[54] COMPUTER CONTROLLED TARGET SHOOTING SYSTEM

[76] Inventor: Tye M. Conlan, 610 Anderson Rd., Davis, Calif. 95616-3511

[21] Appl. No.: 157,472

[22] Filed: Nov. 26, 1993

[51] Int. Cl.[6] ..... A63B 63/00

[52] U.S. Cl. ..... 273/317; 124/9; 124/43; 273/333; 273/362; 434/11

[58] Field of Search ..... 364/410, 411; 124/9, 43, 72, 46; 273/317, 333, 378, 371, 372, 362; 434/11, 13, 16, 19

[56] References Cited

U.S. PATENT DOCUMENTS

| | | | |
|---|---|---|---|
| 329,211 | 10/1885 | Raub | 124/46 |
| 2,055,097 | 9/1936 | Eccles et al. | 273/362 |
| 3,565,432 | 2/1971 | Reiner | 273/317 |
| 3,589,727 | 6/1971 | Lowry | 273/317 |
| 3,637,212 | 1/1972 | Hurley | 273/316 |
| 3,680,863 | 8/1972 | Smith, Jr. et al. | 273/362 |
| 3,722,495 | 3/1973 | Housen | 124/9 |
| 3,761,088 | 9/1973 | Brown | 273/316 |
| 3,800,775 | 4/1974 | Darrell | 124/43 |
| 3,821,945 | 7/1974 | Foster | 124/9 |
| 3,923,033 | 12/1975 | Laporte et al. | 124/43 |
| 3,937,203 | 2/1976 | Riedmueller | 124/9 |
| 3,937,204 | 2/1976 | Alday | 124/9 |
| 3,971,357 | 7/1976 | LaPorte et al. | 124/43 |
| 4,146,007 | 3/1979 | Alday et al. | 124/9 |
| 4,205,651 | 6/1980 | Rovero | 124/43 |
| 4,266,776 | 5/1981 | Goldfarb | 364/410 |
| 4,481,932 | 11/1984 | Olson | 124/43 |
| 4,482,325 | 11/1984 | Reimann | 273/317 |
| 4,921,250 | 5/1990 | Ayres | 273/317 |
| 5,007,649 | 4/1991 | Richardson | 364/410 |
| 5,018,736 | 5/1991 | Pearson et al. | 364/410 |
| 5,112,051 | 5/1992 | Darling et al. | 364/410 |
| 5,194,006 | 3/1993 | Zaenglein, Jr. | 434/19 |
| 5,194,008 | 3/1993 | Mohan et al. | 434/22 |

*Primary Examiner*—Gail O. Hayes
*Assistant Examiner*—Frantzy Poinvil

[57] ABSTRACT

A computer controlled target shooting system having a plurality of clay bird throwers which can be positioned at substantial distances and angles of throw from one another, preferably to throw clay birds in a safe direction for shooter(s) to engage. The throwers include a device for mechanical activation (electrical, air, hydraulic, etc.) and allow for varying horizontal and vertical angle of clay bird projection (flight). The plurality of clay bird throwers are interfaced to a microprocessor. The shooter can specify levels of difficulty which will set levels of time delays and difficulty of randomness between clay birds thrown. These shooter specified levels include two clay birds thrown at the same time (doubles) and extended time delay to allow for reloading of double barrel shotgun (double barrel). The microprocessor keeps track of shooter location within the system, throws clay birds for the shooter dependent on shooter location within the system and shooter parameters specified before entering the system. This system simulates an actual bird hunt (pheasant, quail, etc.) by providing randomness and unpredictability through microprocessor control.

22 Claims, 20 Drawing Sheets

COMPUTER CONTROLLED TARGET SHOOTING SYSTEM

BACKGROUND OF THE INVENTION

1. Field of the Invention

The invention relates in general to certain new and useful improvements in clay bird throwing devices, and more particularly to target throwing devices from multiple locations where the shooter(s) proceed down a specified path that changes the shooter(s) location within the system.

2. Brief Description of the Prior Art

There have been a number of commercially available target throwing apparatus, that is an apparatus in which a target (clay bird) is thrown. As an example a manual or automatic loading and throwing device is designed to throw a plurality of targets from a single position with adjustable vertical and horizontal angles of throw (flight).

There have been a number of target throwing apparatus with both vertical and horizontal angles of target throwing from multiple positions. The shooter sets up in a position ready to engage the targets and other people either throw targets or activate controls that throw targets from multiple positions. These target throwing devices and systems are set up for operation with an additional person(s) besides the shooter(s) to control the system. Moreover, they contain the element of predictability which is not present in an actual bird hunt (pheasant, quail, etc.)

With the advent of microprocessors, there have been a number of commercially available automatic loading and throwing clay bird throwers. Many of these throwers are activated by a remote control. These throwers each have a remote control and are activated independently. These systems operate by having the shooter shoot from different locations around a specific clay bird thrower(s). These clay bird throwing systems are activated by command, this command activation makes the clay bird systems predictable. More importantly, these systems still require the presence of another person to activate the system.

OBJECTS OF THE INVENTION

It is, therefore, a primary object of the present invention to provide an improved target throwing system which is comprised of a plurality of target throwing apparatus which are positioned at substantial distances and angles of throw from one another, preferably to throw clay birds in a safe direction for the shooter to engage.

It is another object of the present invention to provide a plurality of target throwing apparatus which are mechanically activated (electrical, air, hydraulic, etc.) through a centralized control unit which provides the necessary components to position (horizontally and vertically), sensor and throw clay birds from the plurality of target throwing apparatus.

It is another object of the present invention to provide a microprocessor which controls the operation of the centralized control unit to provide the necessary interface to receive inputs and determine outputs dependent on control software.

It is another object of the present invention to provide a shooter interface to allow the shooter to specify levels of difficulty which will set levels of time delays and difficulty of randomness between clay birds thrown.

It is another object of the present invention to monitor shooter location within the system with a plurality of shooter location sensors to interface to the centralized control unit which in turn is interfaced to the microprocessor.

It is another object of the present invention to provide randomness and unpredictability through the control logic (software) in this system which will simulate the hunting of actual birds (pheasants, quail, etc.) in that as the shooter inputs more difficult skill levels, the randomness, unpredictability and difficulty of the system will increase.

With the above and other objects in view, my invention resides in the novel features of form, construction, arrangement and combination of parts presently described and pointed out in the claims.

SUMMARY OF THE INVENTION

A multiple target shooting system in which each of a plurality of target throwing apparatus have varying horizontal and vertical angles of clay bird projection and the shooter activates sensor such that the microprocessor recognizes shooter location within the system. From user entries into the microprocessor, the microprocessor will monitor, control and activate clay bird throwers. The targets will be thrown in a safe direction for the shooter to engage with the target throwing apparatus unconnected except for control inputs and outputs which connect the target throwing apparatus to one another. Moreover, the plurality or target throwing apparatus may be positioned at substantial distances from each other with variable horizontal and vertical angles of clay bird projection.

The plurality of target throwing apparatus are randomly or apparently randomly activated; the difficulty of randomness, time delays and direction of clay bird flight dependent on shooter parameters specified before entering the system. For example, as the shooter specifies a more difficult level, the microprocessor will control the plurality of clay bird throwers with increased randomness, (increase in unpredictability), more difficult angles of clay bird flight and a larger variation in time delays between clay birds thrown (increase in unpredictability).

This system is designed to increase a shooters skills by increasing difficulty as shooter skill levels increase. The unpredictability of this system will simulate an actual bird hunt (pheasant, quail, etc.). This system will train the shooter to hunt more instinctively, develop quicker reactions and improve a shooters accuracy through a simulation of actual bird hunting.

The invention possesses many other advantages and has other purposes which may be made more clearly apparent from a consideration of one or more forms in which it may be embodied. These forms are shown in the drawings accompanying and form a part of the present application. They will now be described in detail for purposes of illustrating the general principles of the invention; but it is to be understood that such detailed descriptions are not to be taken in a limiting sense.

BRIEF DESCRIPTION OF THE DRAWINGS

Figure 1:
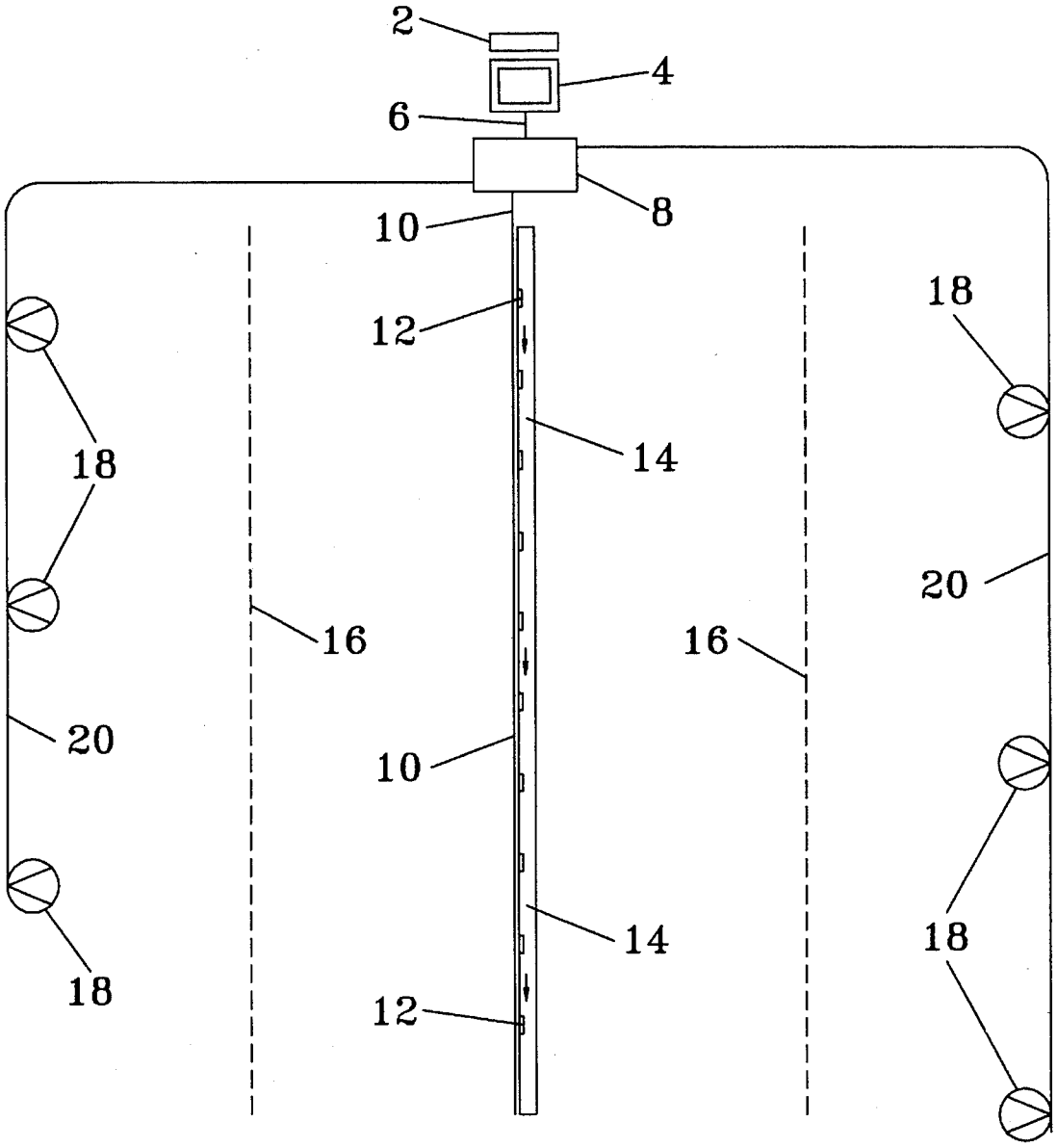

Having thus described the invention in general terms, reference will now be made to accompanying drawings in which:

FIG. 1 is a schematic top view showing a plurality of automatic clay bird throwers (6) and shooter location sensors with the microprocessor control unit forming part of the computer controlled target shooting system of the present invention.

Figure 2:
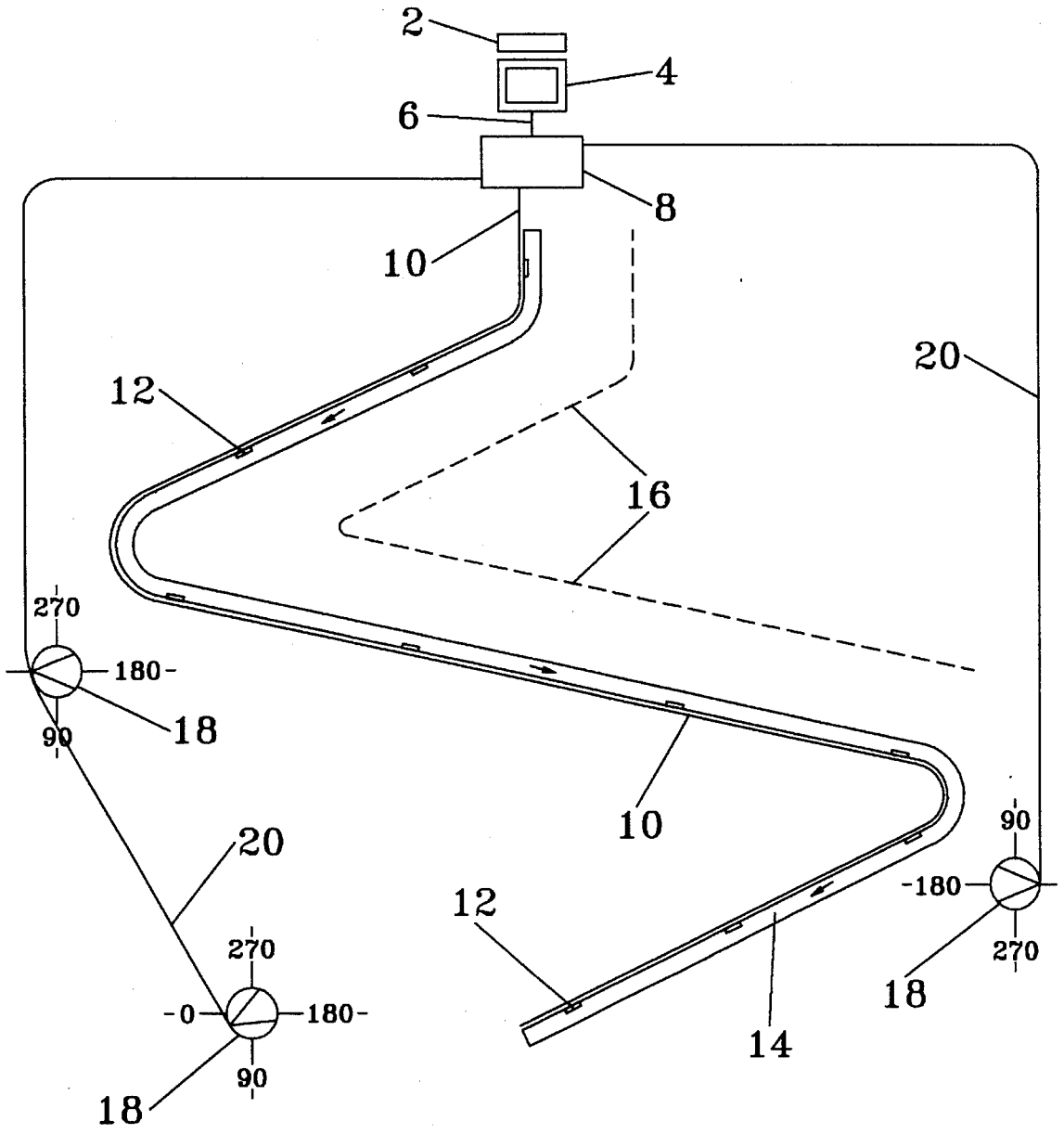

FIG. 2 is a schematic top view showing a plurality of automatic clay bird throwers (3) and shooter location sensors with the microprocessor control unit forming part of the computer controlled target shooting system of the present invention.

Figure 3:
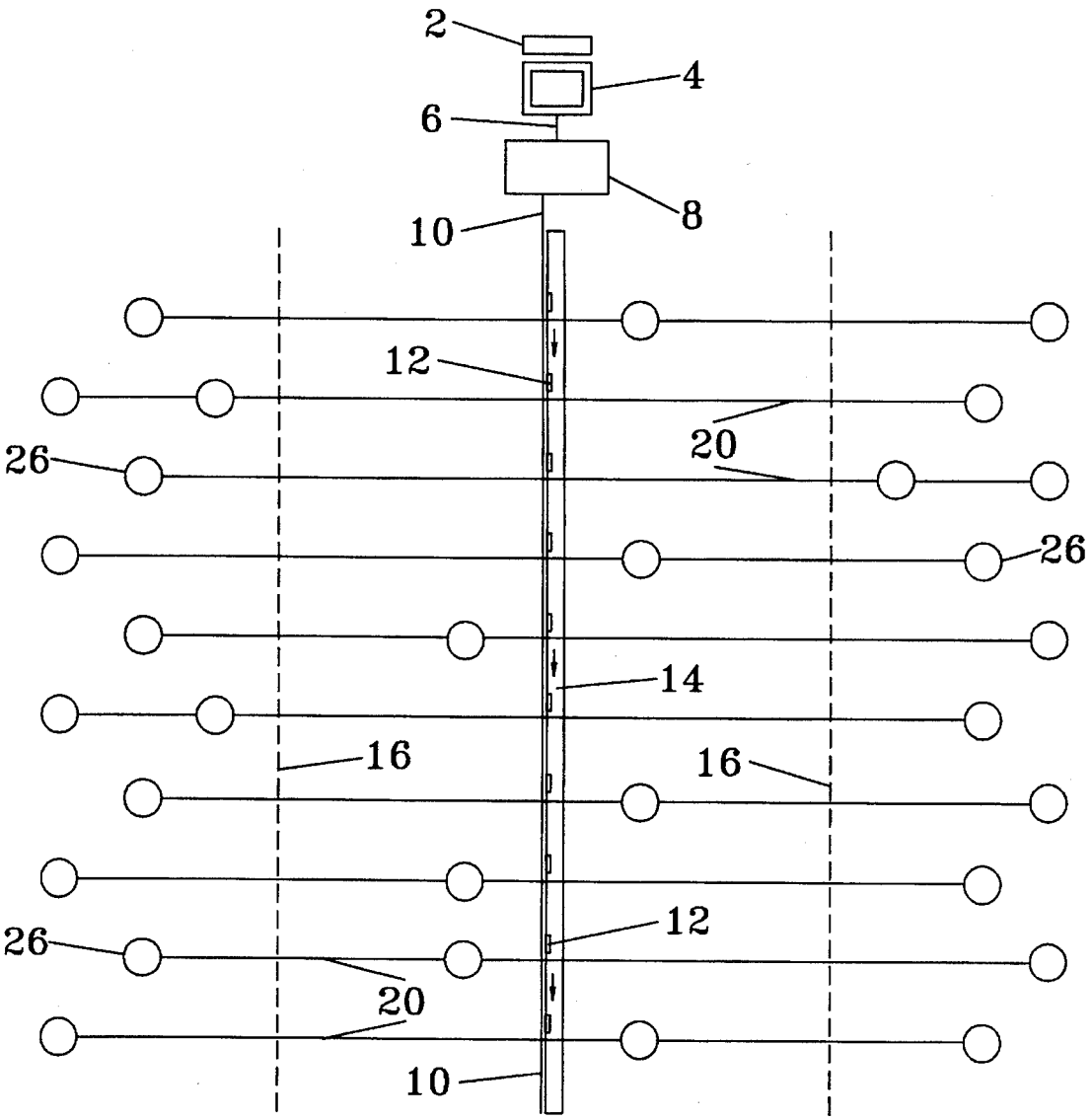

FIG. 3 is a schematic top view showing a plurality of manual clay bird throwers (30) and shooter location sensors with the microprocessor control unit forming part of the computer controlled target shooting system of the present invention.

Figure 4:
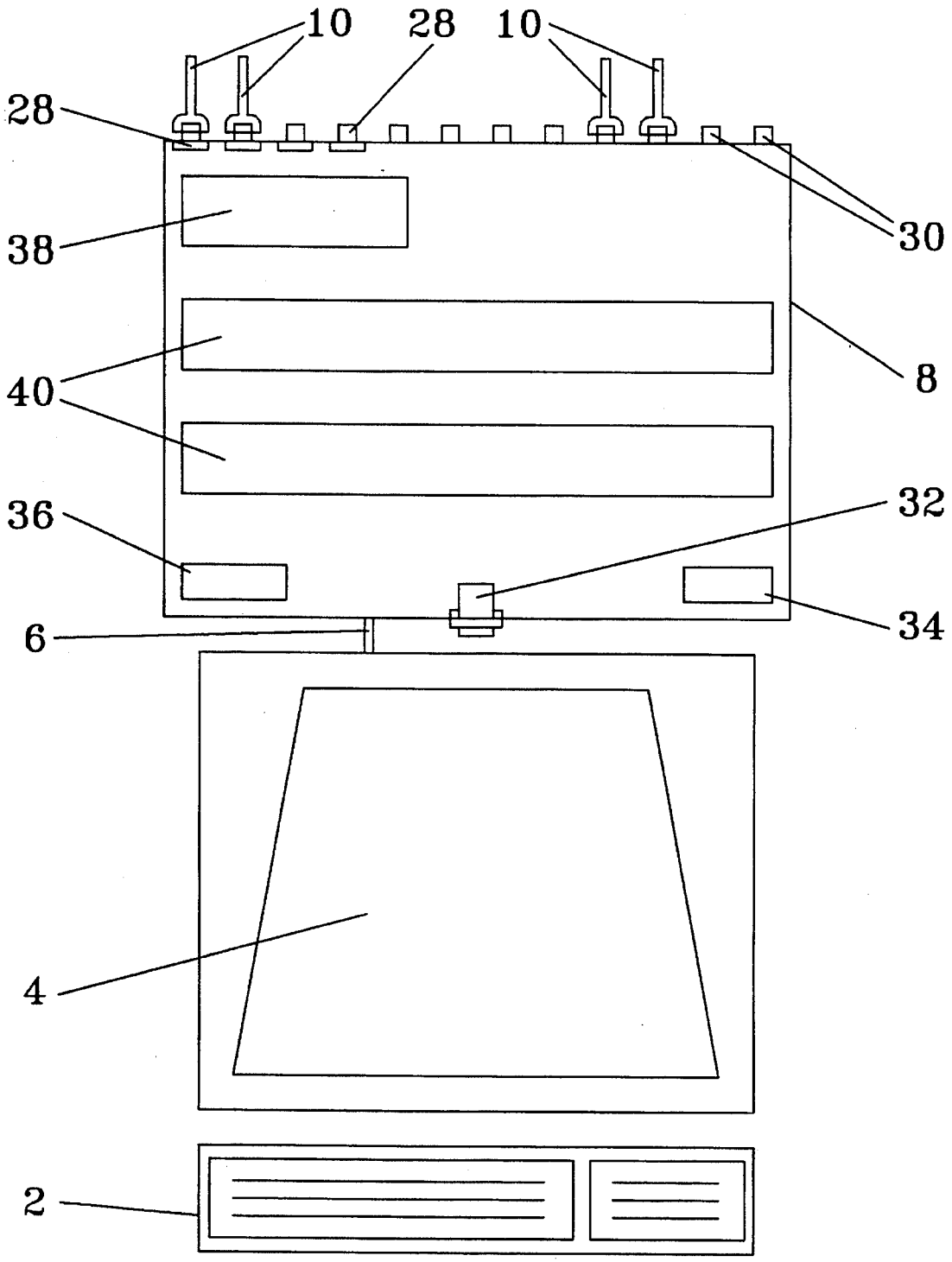

FIG. 4 is a schematic top view showing the computer and interface drivers and receivers with system inputs and outputs all sensor and thrower signals.

Figure 5:
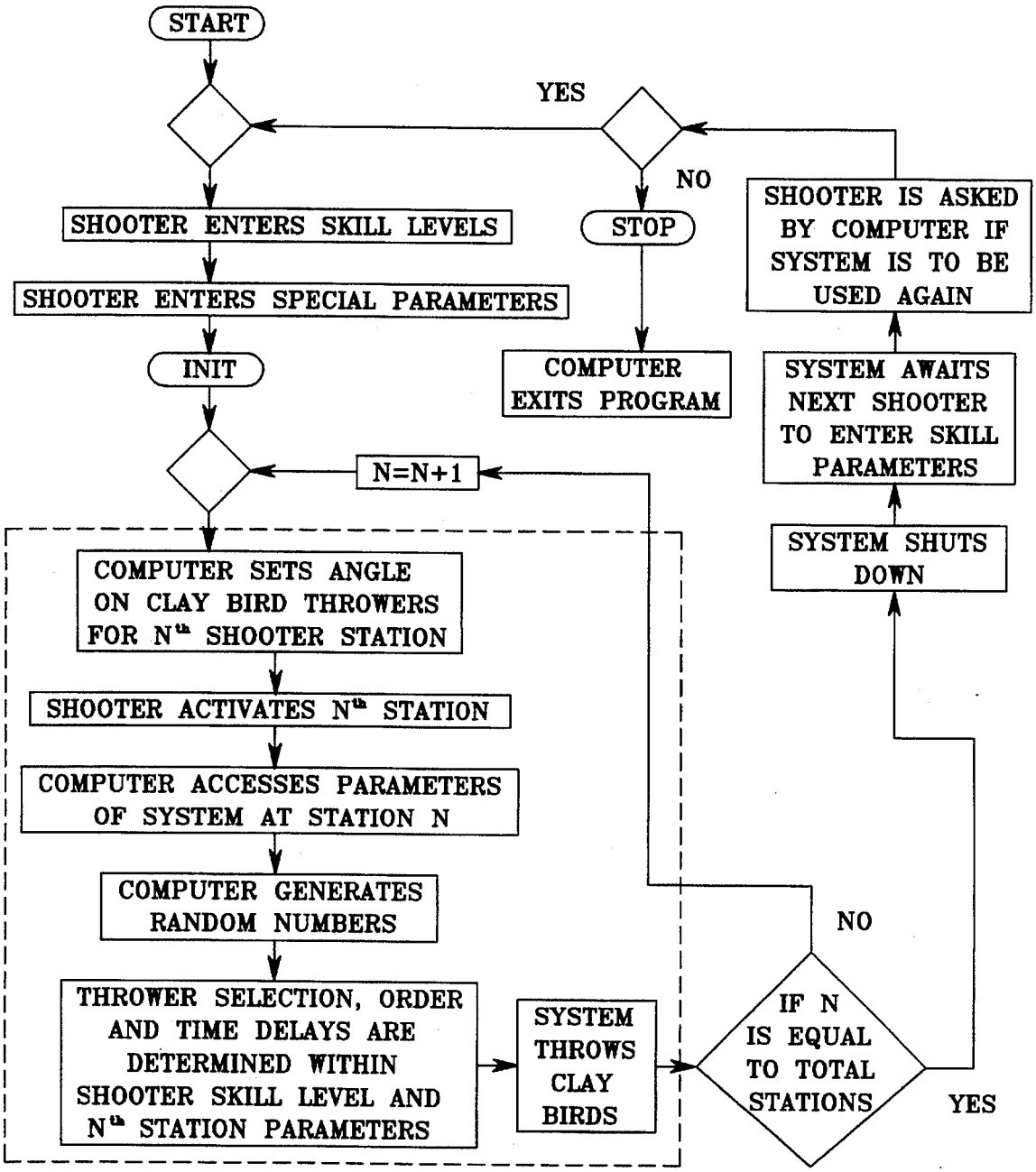

FIG. 5 is a flow chart of system operation showing the shooter skill level entries and special parameters to initialize the system.

Figure 6:
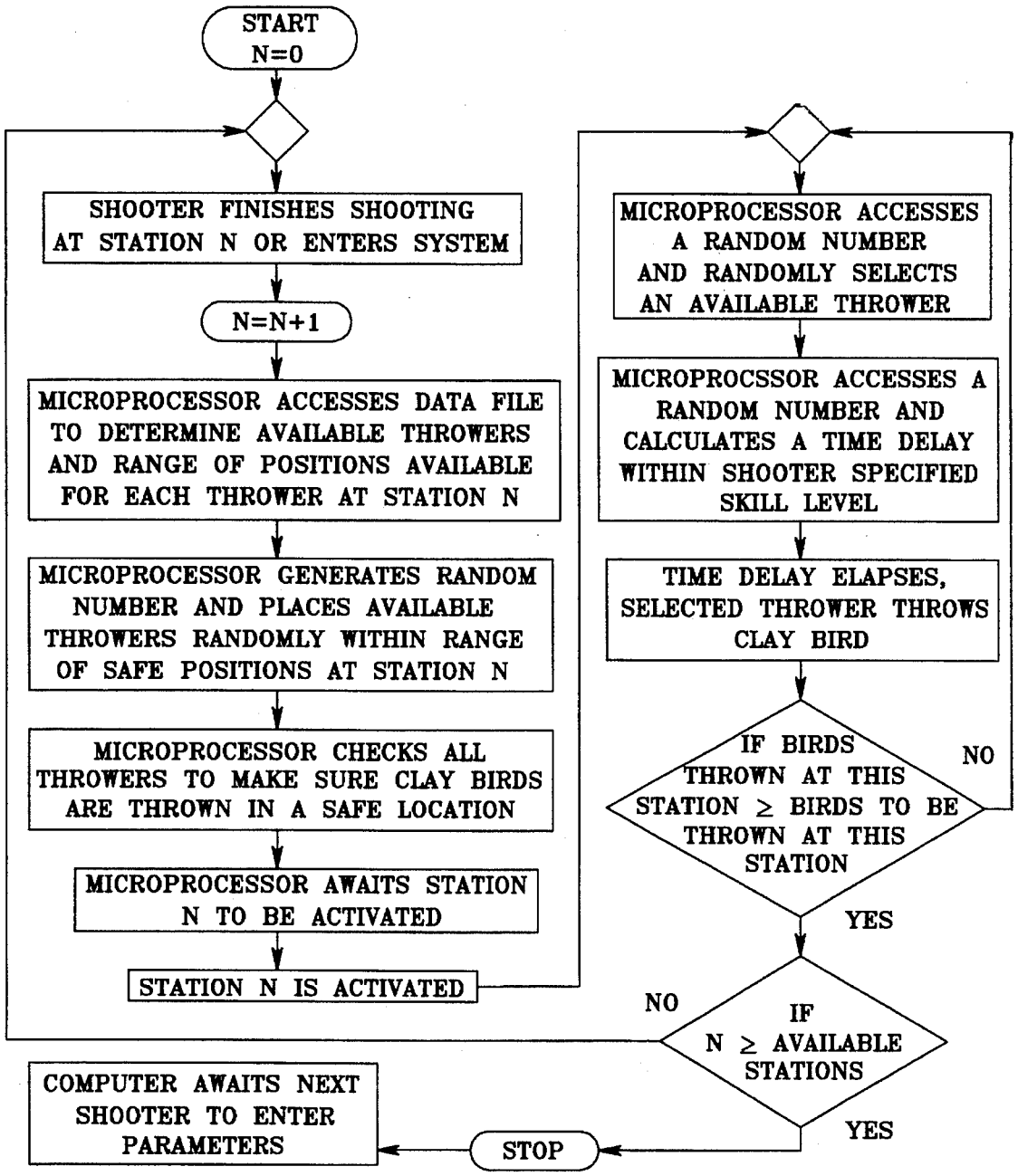

FIG. 6 is a flow chart showing specific operation of the system at a station trigger through thrower selection and is a detailed flow chart at a station trigger encompassed and noted in the dashed line of FIG. 5.

Figure 7:
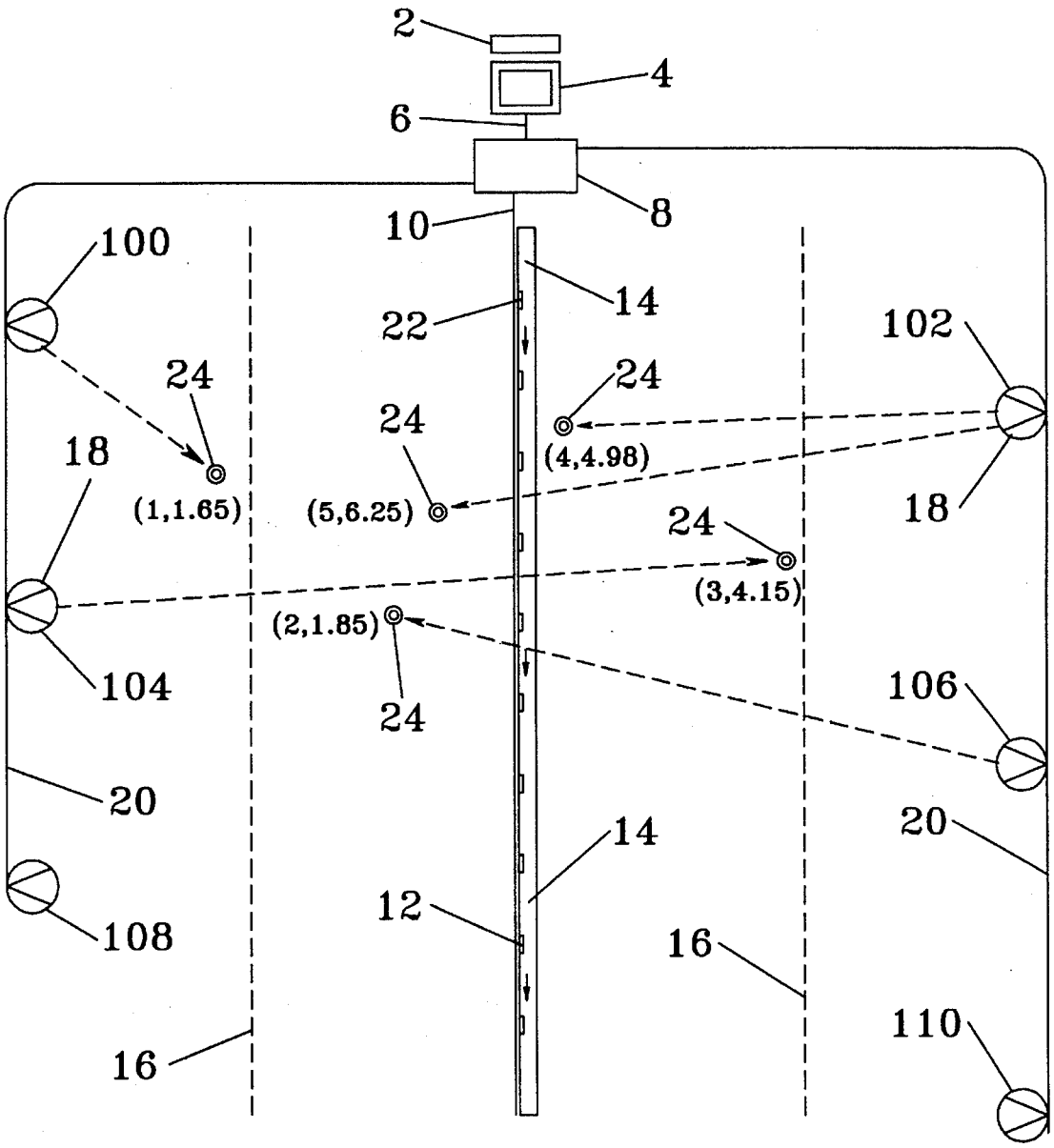

FIG. 7 is the first schematic top view showing operation of FIG. 1, from the first shooter station forming part of the microprocessor controlled target shooting system of the present invention.

Figure 8:
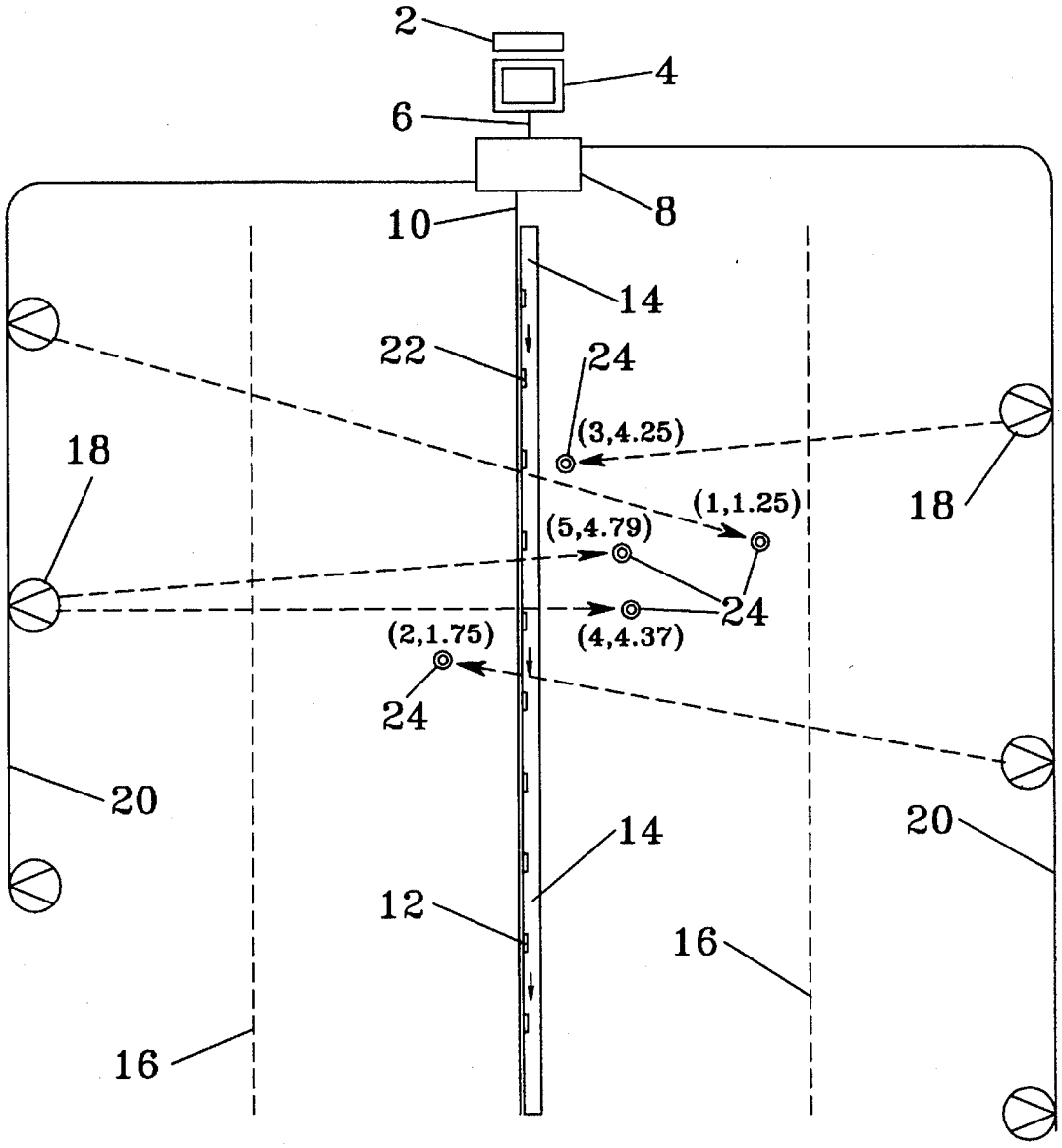

FIG. 8 is the second schematic top view showing operation of FIG. 1, from the second shooter station forming part of the microprocessor controlled target shooting system of the present invention.

Figure 9:
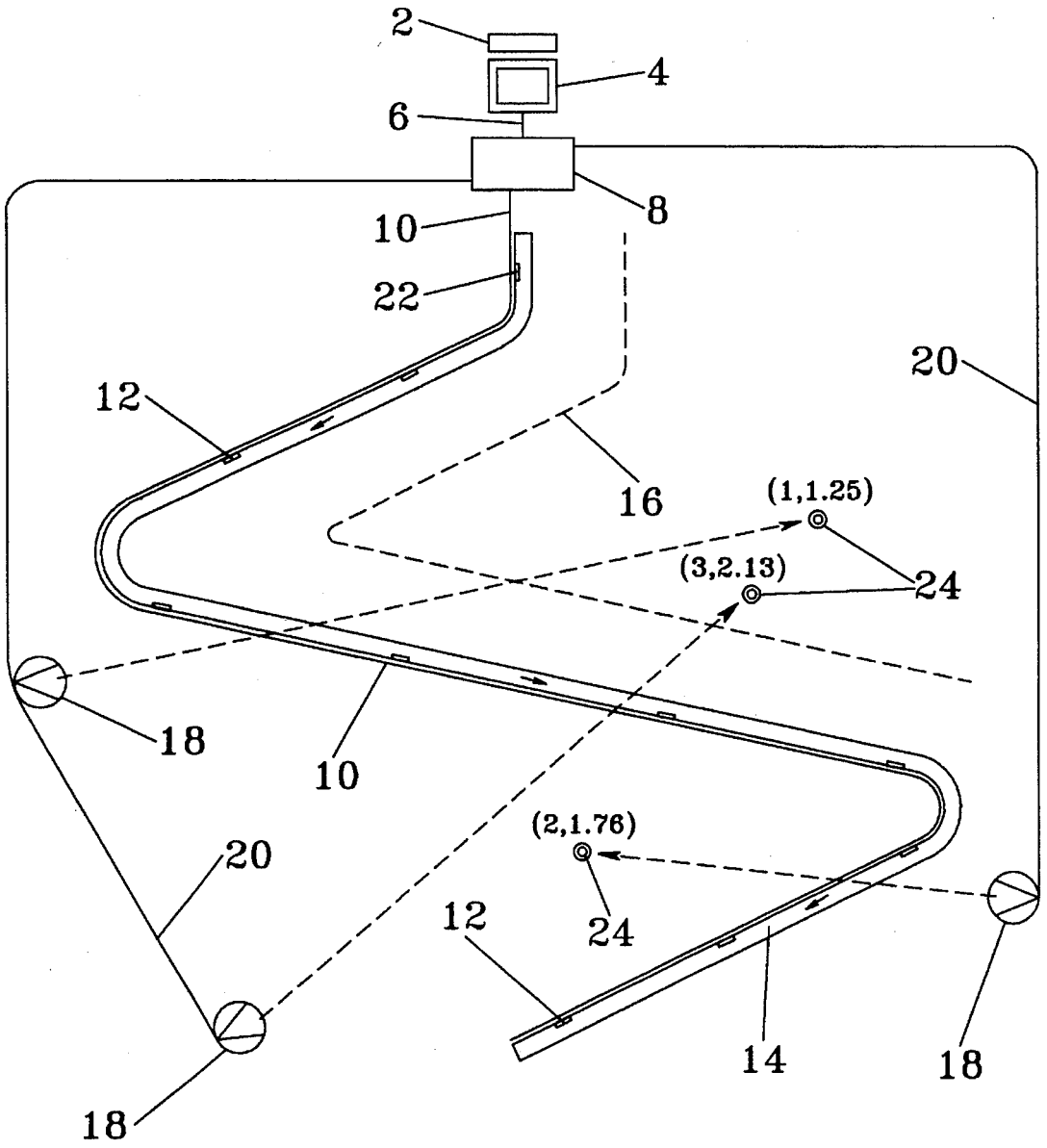

FIG. 9 is the first schematic top view showing operation of FIG. 2, from the first shooter station forming part of the microprocessor controlled target shooting system of the present invention.

Figure 10:
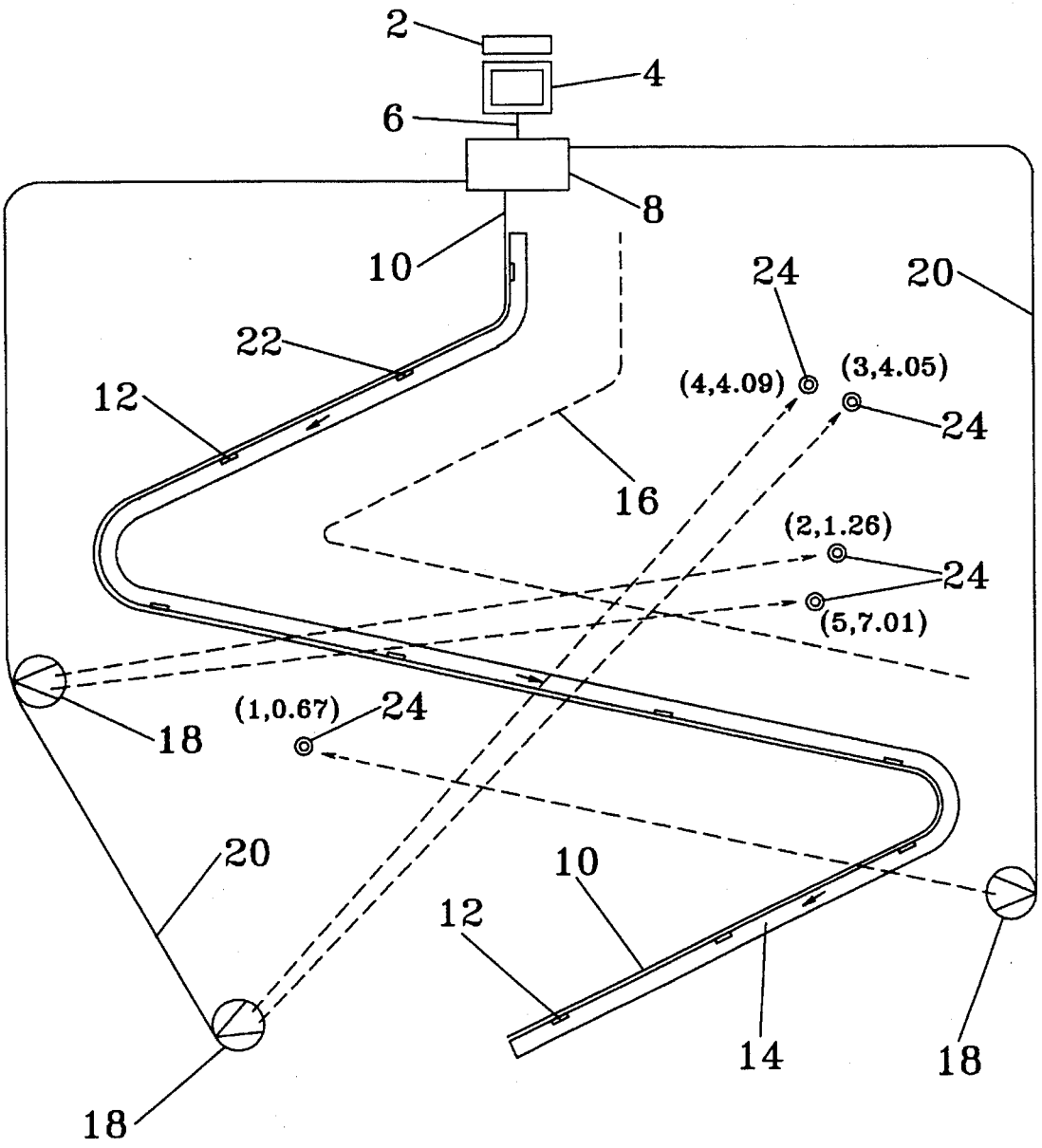

FIG. 10 is the second schematic top view showing operation of FIG. 2, from the second shooter station forming part of the microprocessor controlled target shooting system of the present invention.

Figure 11:
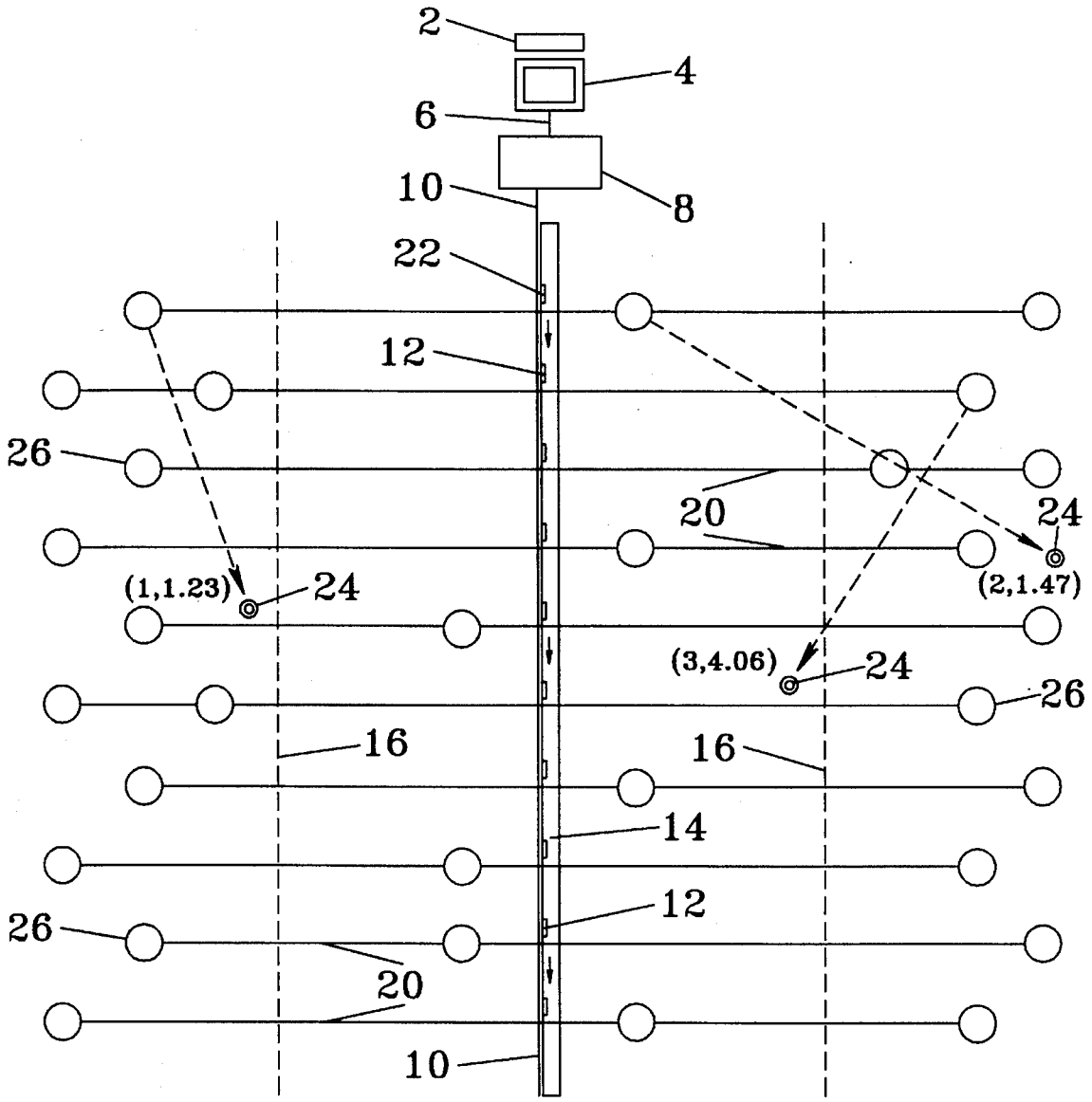

FIG. 11 is the first schematic top view showing operation of FIG. 3, from the first shooter station forming part of the microprocessor controlled target shooting system of the present invention.

Figure 12:
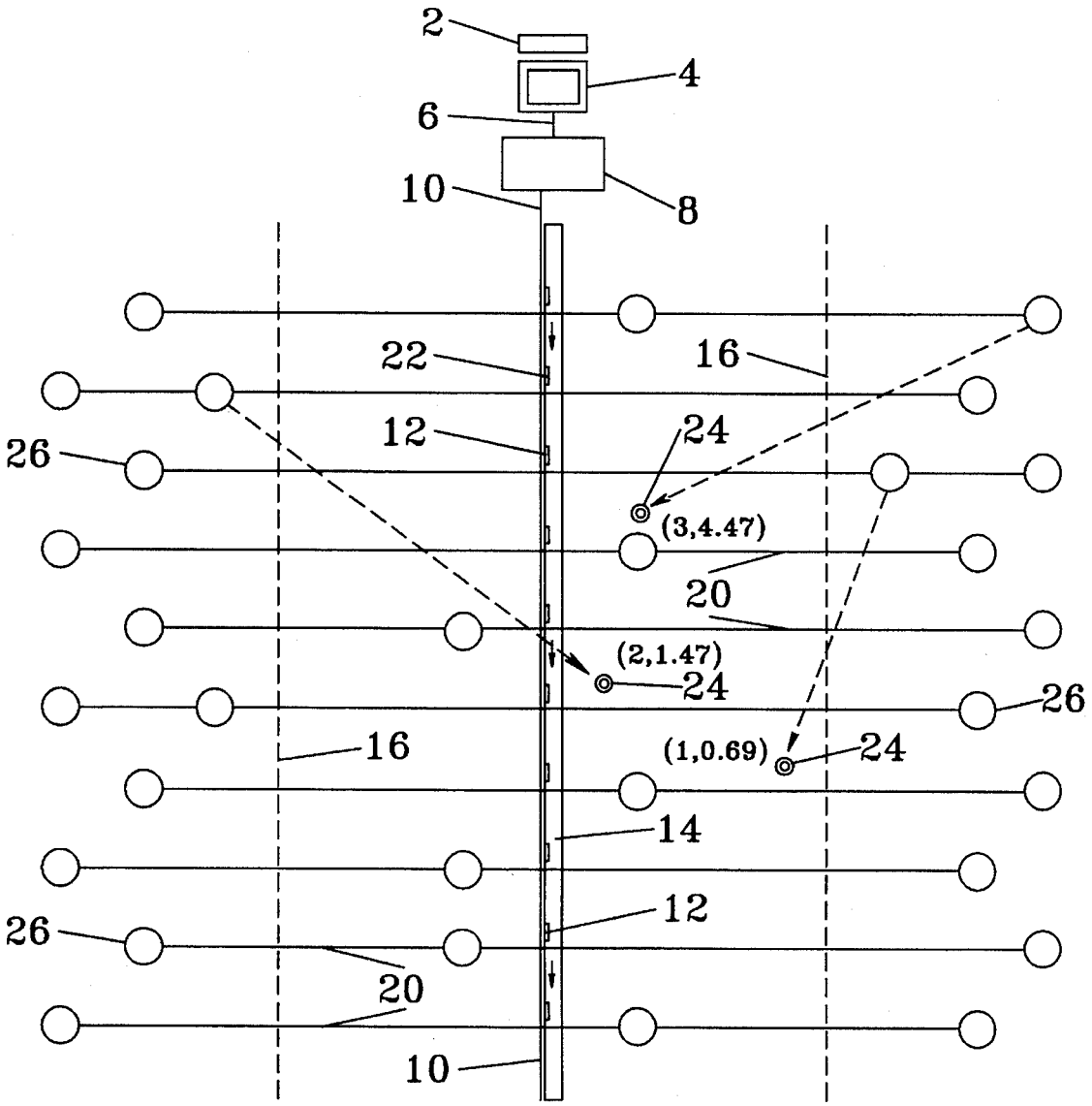

FIG. 12 is the second schematic top view showing operation of FIG. 3, from the second shooter station forming part of the microprocessor controlled target shooting system of the present invention.

Figure 13:
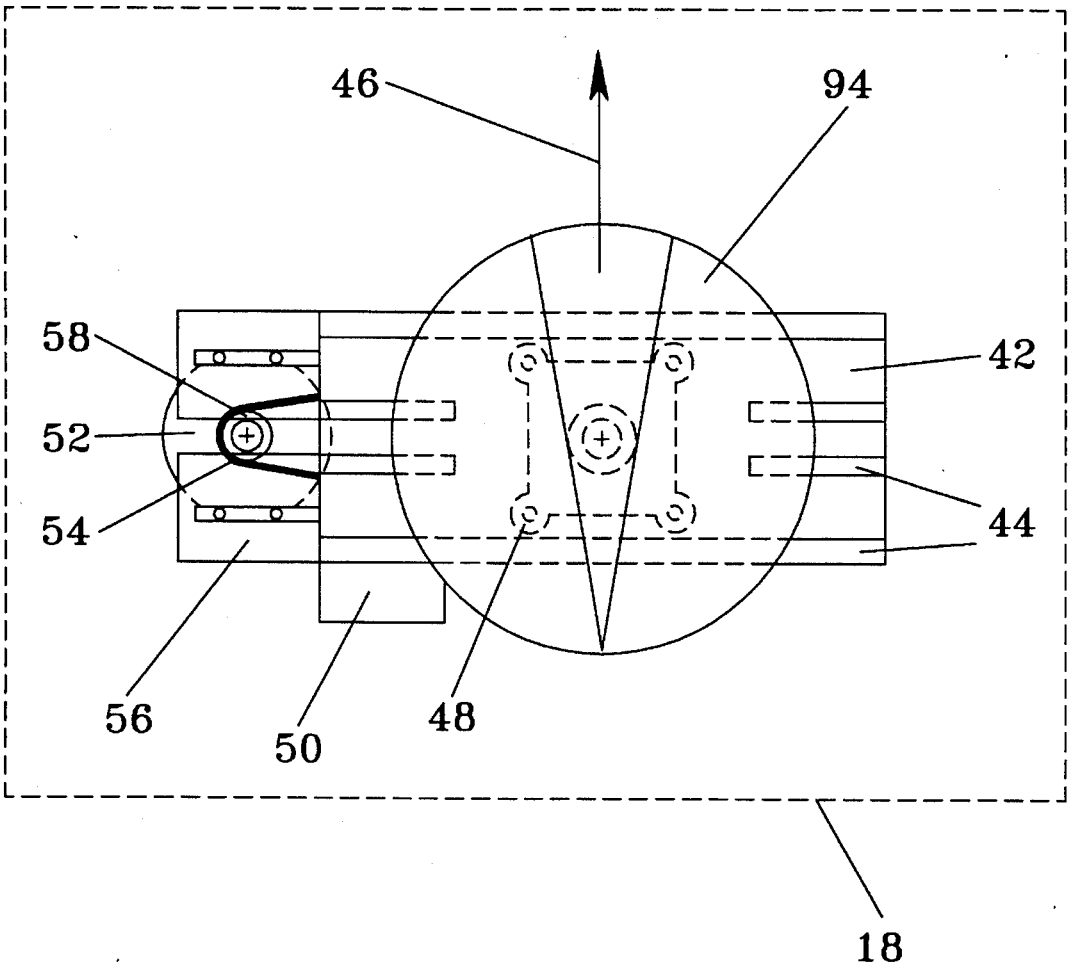

FIG. 13 is a schematic top view of an automatic clay bird thrower on top of a microprocessor controlled turntable to show operation of a single turntable forming part of the microprocessor controlled target shooting system of the present invention.

Figure 14:
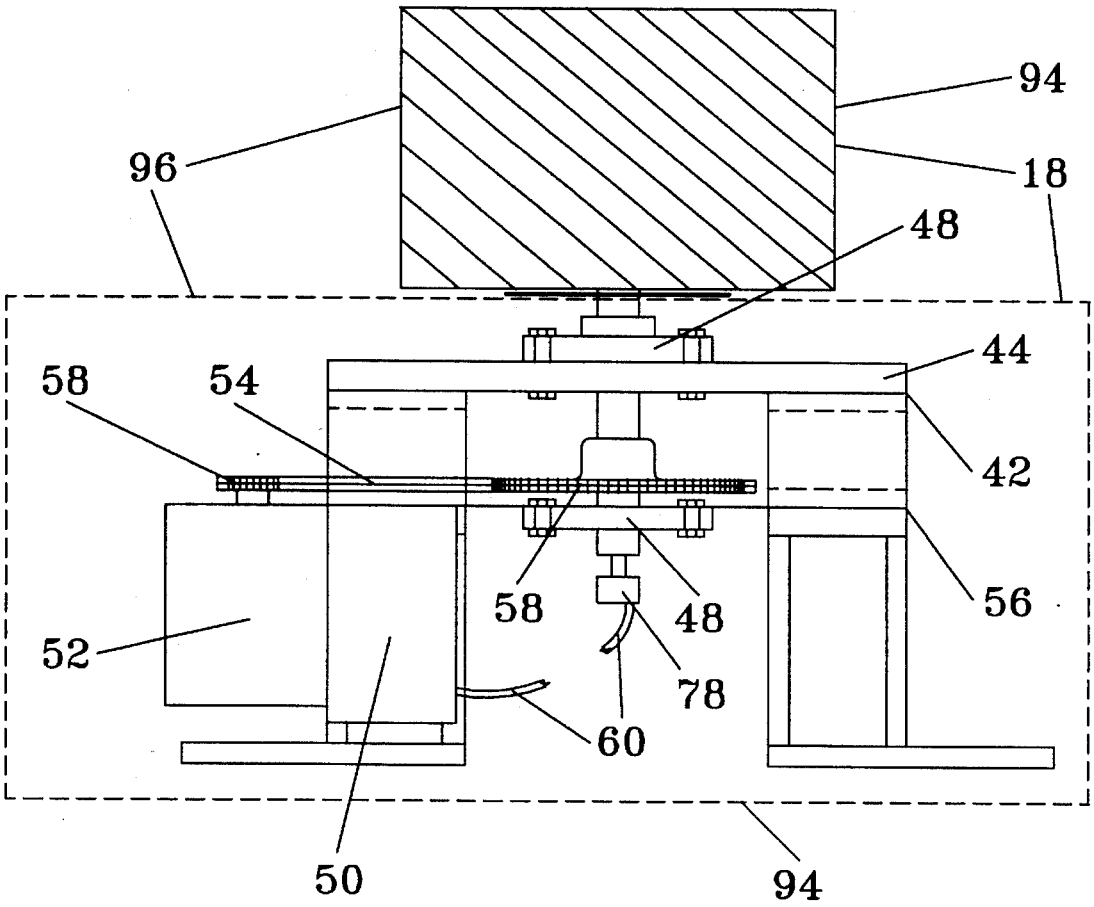

FIG. 14 is a schematic side view of an automatic clay bird thrower on top of a microprocessor controlled turntable to show operation of a single turntable forming part of the microprocessor controlled target shooting system of the present invention.

Figure 15:
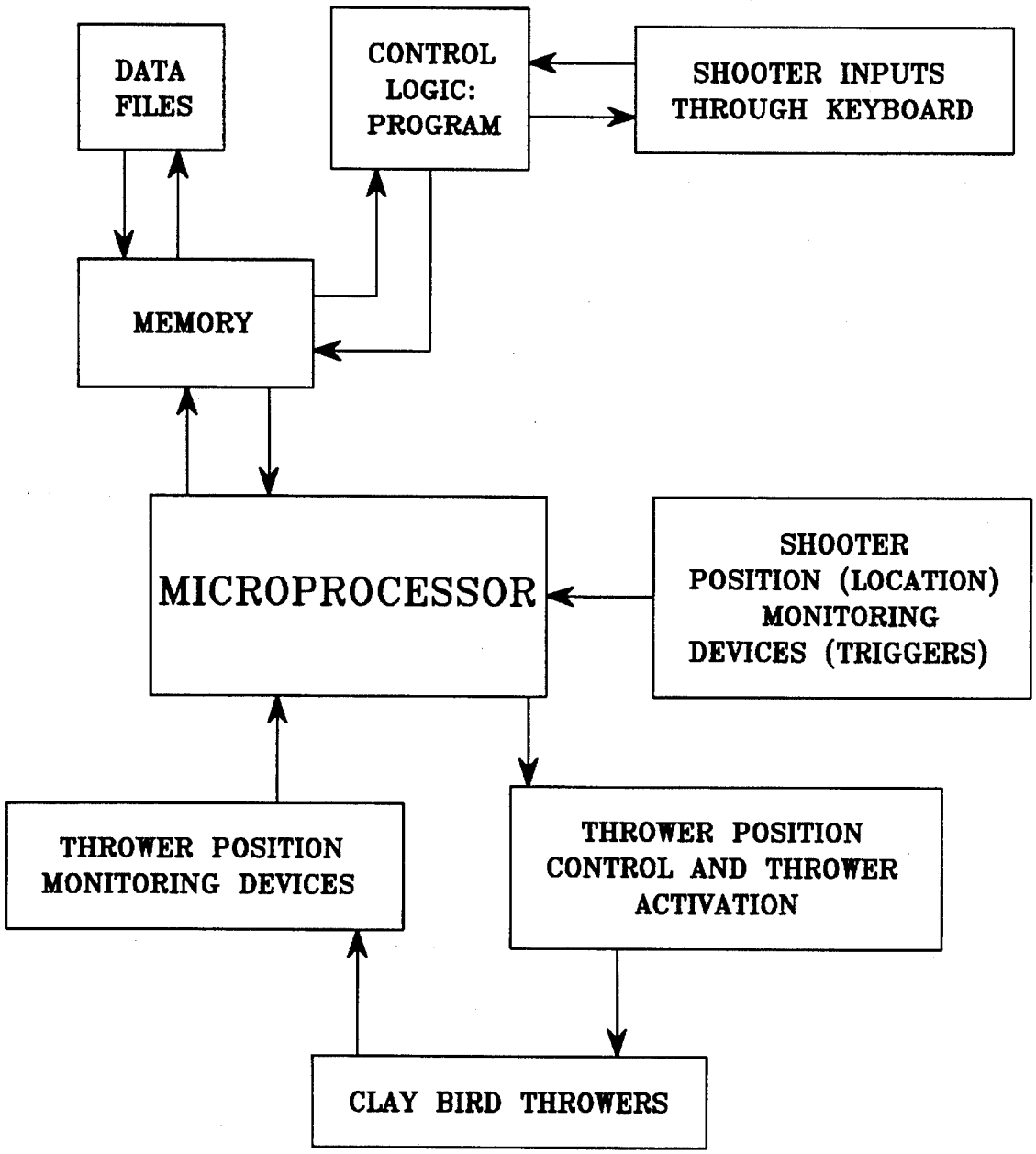

FIG. 15 is a block diagram representation of the microprocessor control system, forming part of the microprocessor controlled target shooting system of the present invention.

Figure 16:
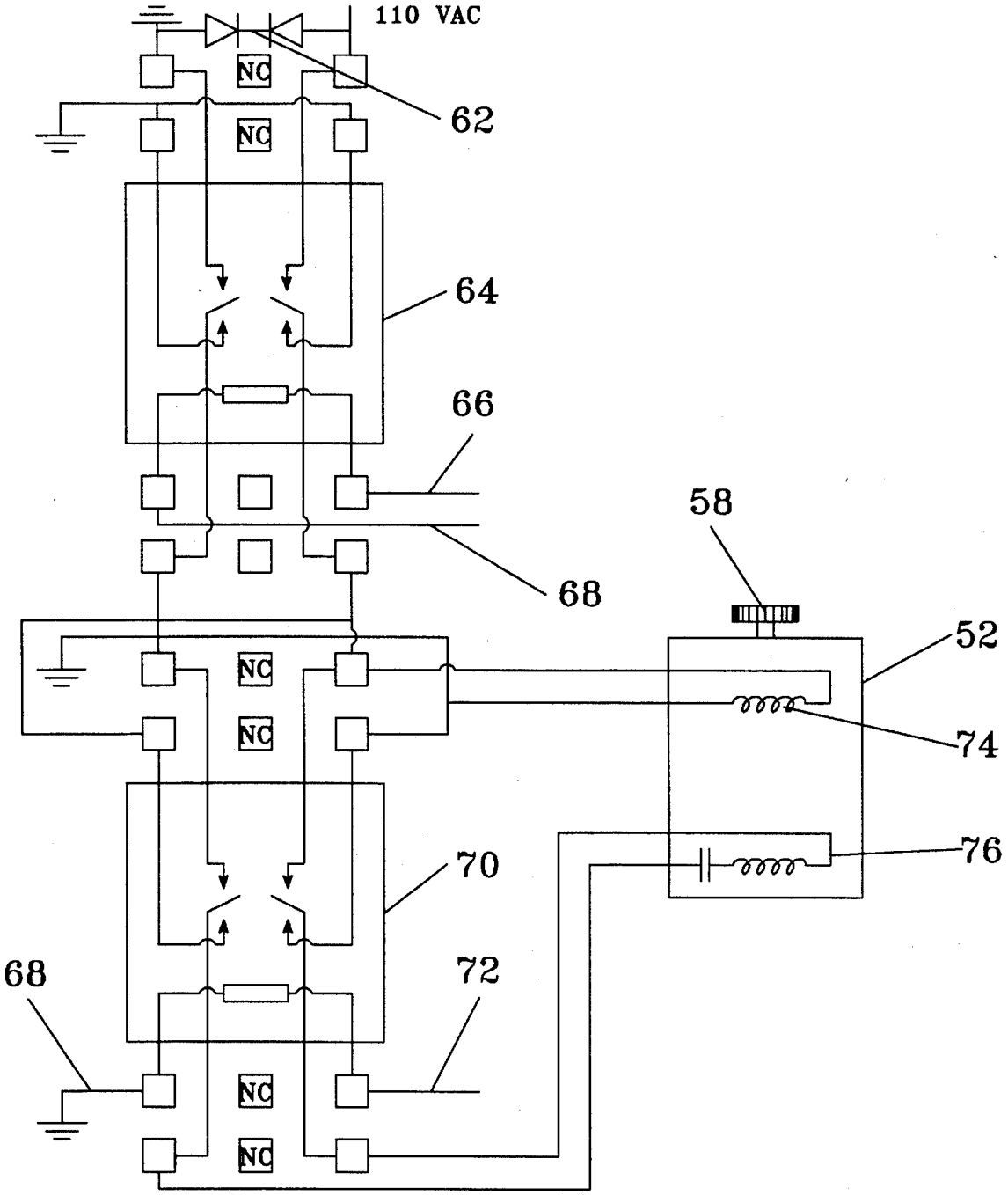

FIG. 16 is a schematic diagram representation of the circuit to reverse the direction of the turntable used to position the automatic loading and throwing clay bird thrower, forming part of the microprocessor controlled target shooting system of the present invention.

Figure 17:
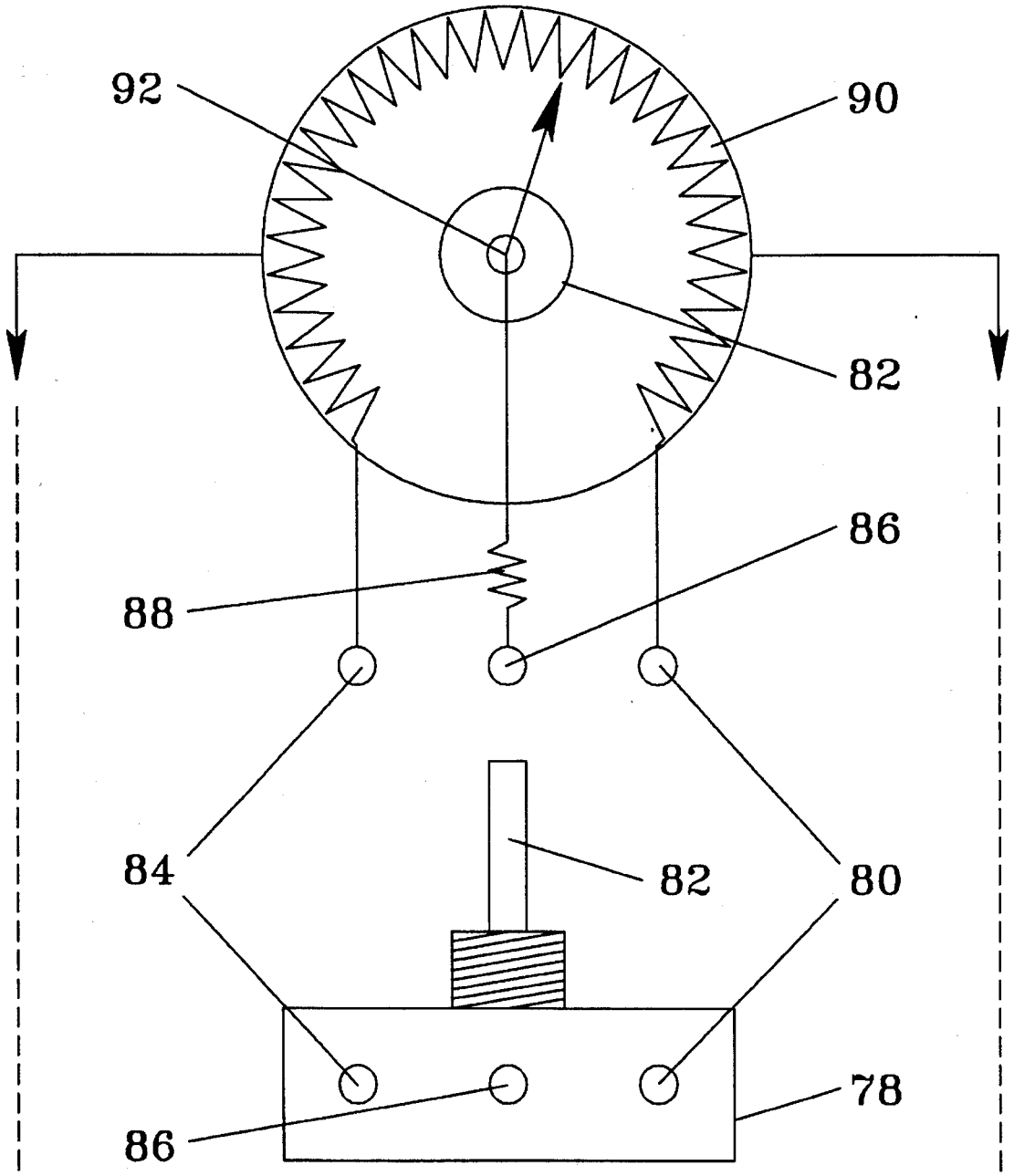

FIG. 17 is a schematic diagram representation of the circuit to measure the position of the automatic loading and throwing clay bird thrower, forming part of the microprocessor controlled target shooting system of the present invention.

Figure 18:
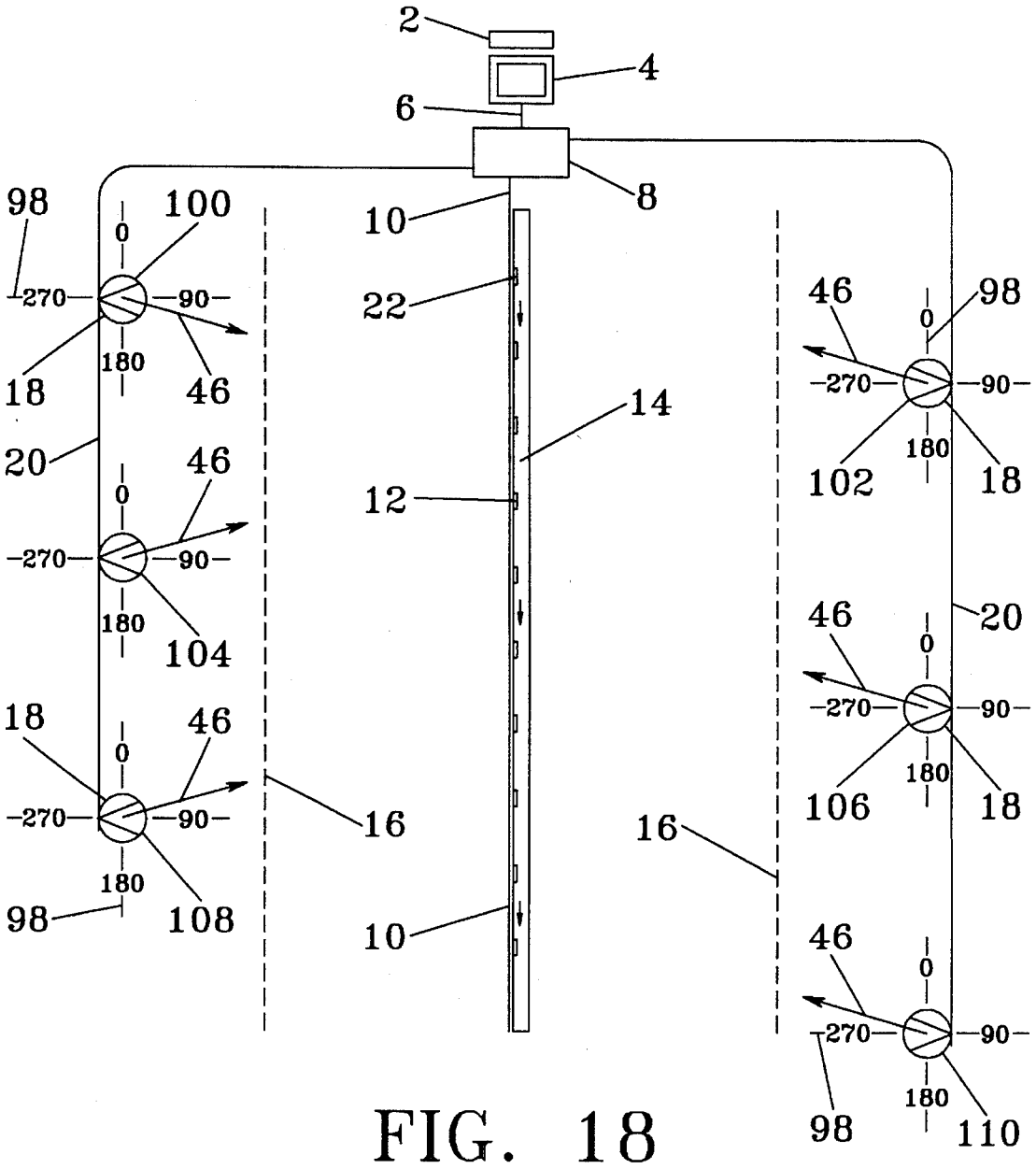

FIG. 18 is a schematic top view showing range of system operation for operation at station one of FIG. 1, from the first shooter station forming part of the microprocessor controlled target shooting system of the present invention.

Figure 19:
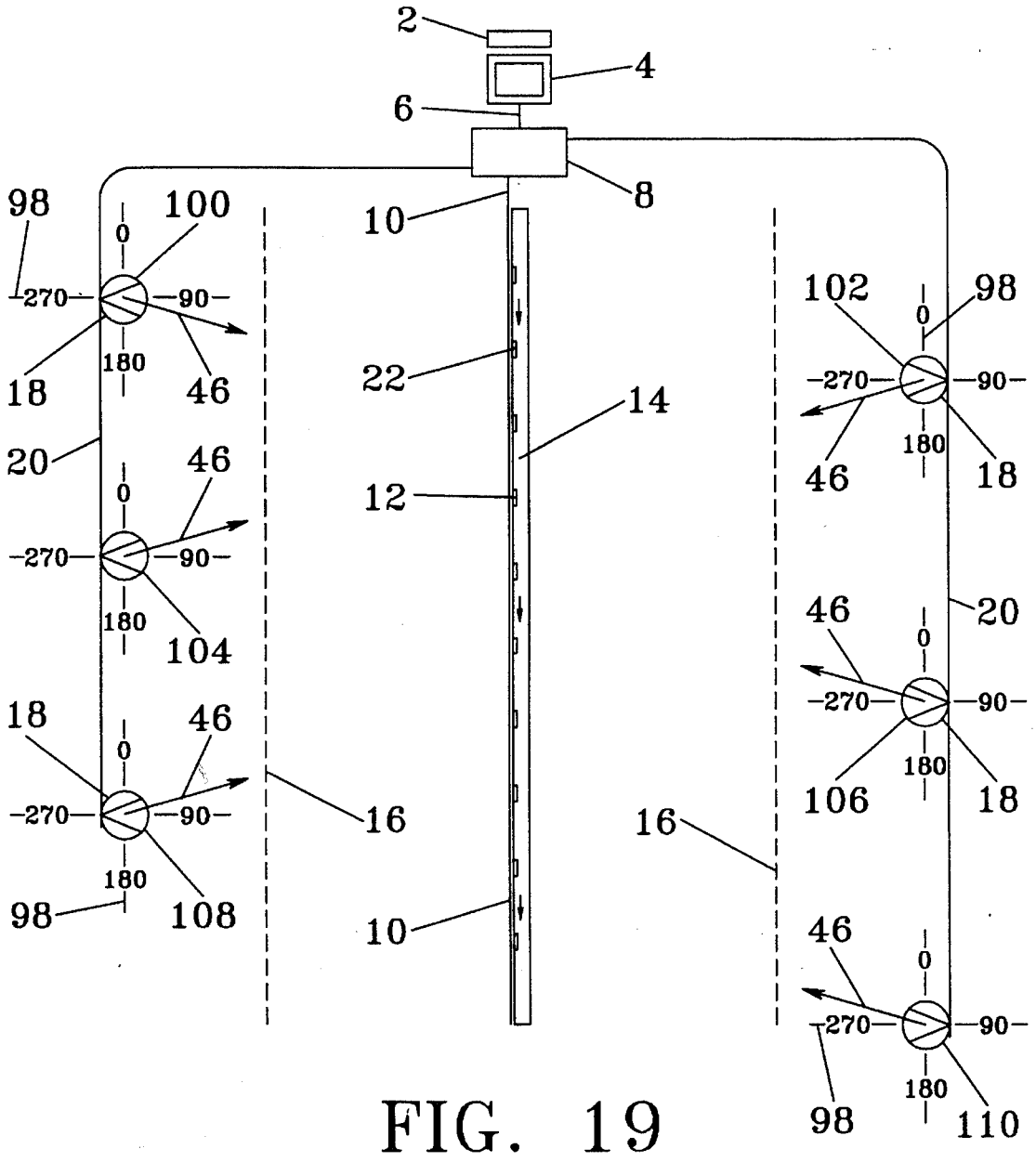

FIG. 19 is a schematic top view showing range of system operation for operation at station two of FIG. 1, from the second shooter station forming part of the microprocessor controlled target shooting system of the present invention.

Figure 20:
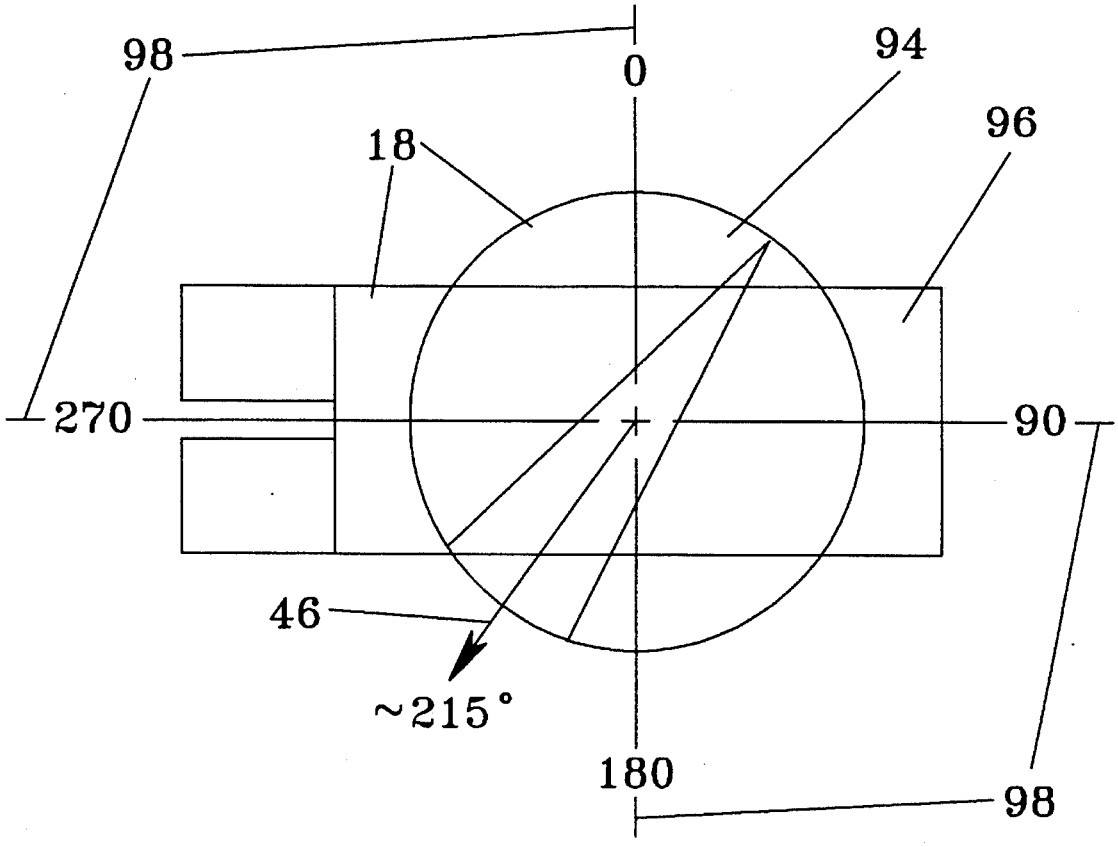

FIG. 20 is a top view of an automatic clay bird thrower on top of a microprocessor controlled turntable, the detail of the microprocessor controlled turntable is limited due to FIG. 19 is specifically intended to show degree markings to determine direction clay birds will be thrown.

DETAILED DESCRIPTION OF THE PREFERRED EMBODIMENTS

Referring now in more detail and by reference characters to the drawings which illustrate a preferred and practical embodiment of the present invention, M designates a microprocessor controlled target shooting system (FIGS. 1, 2 and 3) comprising of a plurality of clay bird 24 throwers T (designations 18 and 26). The term "microprocessor" 4 is generally used synonymous with the term "microcomputer" or "computer".

The microprocessor control unit 4 of the target shooting system M is capable of accepting shooter entries 2 on difficulty of system M operation, primary shooter 14 enters the number of clay birds 24 to be thrown and if additional shooters 16 will be using the system simultaneously. The difficulty of system M operation will set parameters 2 on time delays between successive clay birds 24 thrown and difficulty of angle 46 clay birds 24 are thrown. These shooter parameters 2 will set the control software within the microprocessor 4 to set system M operation that a primary shooter 14 has the required level of skill to engage thrown clay birds 24.

Primary shooter 14 specified parameters 2 can also be entered to accommodate any special requests of the primary shooter 14. Examples of these primary shooter 14 specified requests include type of shotgun, does the shooter want doubles (two clay birds 24 thrown at a time), multiple shooters etc. The type of shotgun specified by the primary shooter 14 will allow additional time delays between clay birds 24, this additional time delay will allow the primary shooter 14 to reload the shotgun. Specifically, a single shot shotgun, double barrel shotgun, pump or automatic shotgun have to be reloaded every one, two and three shots, respectively. The additional time delays to reload and the short time delays to receive doubles will occur randomly, or not in a predictable sequence. Specifically, The doubles routine will not only throw two clay birds with short time delays and the additional time delay for reloading will not only occur every 3 clay birds 24 thrown for the pump or automatic shotgun, it will randomly occur after one, two or three clay birds 24 are thrown.

Once the primary shooter 14 has specified shooter parameters 2 the clay bird 24 system M is ready to be entered. The microprocessor 4 will then set the system M and wait for the first station 22 to be activated (FIG. 7, 9 and 11). The setting of the system will include analysis of primary shooter 14 parameters to determine number of clay birds 24 to be thrown, range of time delays between clay birds 24, order of throwers to be activated and range of safe angles 46 clay birds 24 can be thrown, for this specific shooter station 22. The clay bird 24 throwers 18 will then be positioned for the correct angle 46 of clay bird 24 flight. The microprocessor 4 will then await the activation of the first shooter station 22 (FIG. 7, 9 and 11). Any target throwers not within the specified shooter parameters will be readjusted or shut down by the microprocessor. The primary shooter will proceed down path 14 (FIG. 1–3, 7–12), if additional shooters 16 are using the system M they will proceed down paths 16. The microprocessor 4 will enable the secondary shooter to engage all targets while preventing any person or property to come into the line of fire. Once the first station 22 has been activated the microprocessor 4 will activate the clay bird 24 throwers 18 or 26. An example of the clay bird 24 systems M in operation is in FIG. 7, 24 designates clay birds 24 that were thrown. FIG. 7 shows five clay birds 24 being thrown for the first shooter station 22. The two numbers in parenthesis (a,b) refer to the order of clay bird 24 thrown "a" and the time delay after the first station 22 activation "b".

The clay birds 24 in FIG. 7 will be described. Shooter station 22 is activated at time zero, the first clay bird 24 was thrown 1.65 seconds after shooter station 22 was activated from thrower #1 100. The second clay bird 24 was thrown 1.85 seconds after shooter station 22 was activated from thrower #4 106, or 0.20 seconds after first clay bird 24 was thrown. The third clay bird 24 was thrown 4.15 seconds after shooter station 22 was activated from thrower #3 104. The fourth clay bird 24 was thrown 4.98 seconds after shooter station 22 was activated from thrower #2 102. The fifth clay bird 24 was thrown 6.25 seconds after shooter station 22 was activated from thrower #2 102. This sequence of clay birds 24 thrown is an example of system operation M from shooter station 22 of FIG. 7. The previous description of clay birds 24 in flight is only an example of system M operation. Thrower selection, order, time delays and angle of flight 46 are determined by random number generation and user specified input parameters 2 to system M. Random number generation will occur differently every time system is operated. An example of how the microprocessor 4 operates the system M for one shooter station 22 will be described.

Once all clay birds 24 have been thrown at the first shooter station 22, the microprocessor 4 will then set the system M and wait for the second station to be activated 22 (FIG. 8, 10 and 12). The setting of the system M will again include analysis of shooter parameters 2 to determine number of clay birds 24 to be thrown, range of time delays between clay birds 24 and range of safe angles 46 clay birds 24 can be thrown. The microprocessor 4 will then randomly select order of thrower activation, angle 46 each thrower 18 will throw clay birds 24 and the time delays between each clay bird 24 thrown. The clay bird 24 throwers 18 will then be positioned for the correct angle 46 of clay bird 24 flight. The microprocessor 4 will then await the activation of the second shooter station 22 (FIG. 8, 10 and 12). Once the second station 22 has been activated the microprocessor 4 will activate the clay bird 24 throwers 18 or 26. An example of the second station 22 activation and system M operation is shown in FIGS. 8, 10 and 12.

This procedure of setting the system M and waiting for station activation 22 will continue until the primary shooter 14 has activated all shooter stations 12 in the system M. The microprocessor 4 will then await another primary shooter 14 to enter skill parameters 2, the system M will again go through the procedure of setting for first shooter station 22, waiting for first shooter station activation 22, first shooter station is activated 22, microprocessor 4 activates clay bird 24 throwers 18 or 26, setting for second shooter station 22, waiting for second shooter station activation 22, second shooter station is activated 22, microprocessor 4 activates clay bird 24 throwers 18 or 26, setting for third shooter station 22, etc. A block diagram representation of this procedure is shown in FIGS. 5 and 6. FIG. 5 shows system M operation and FIG. 6 shows clay bird 24 thrower 18 or 26 operation and selection.

A description of how the microprocessor 4 controls the system M will follow. The system M is first made ready and awaits primary shooter 16 entry of skill parameters. The skill parameters will be described first, the primary shooter 14 will be asked by the computer (microprocessor 4) what primary shooter 14 skill level will fit the primary shooter 14. The choices are beginner, intermediate and expert. These skill levels determined by the primary shooter 14 determine set and variable time delays for all shooter stations 12. Difficulty of angle of clay bird 24 thrown, difficulty of random selection process and difficulty of throwers available will be determined for individual shooter stations 22 within the system M.

| Skill level | Set time delay (sec) | Variable time delay (sec) |
|---|---|---|
| Beginner | .75 | .50 |
| Intermediate | .50 | .75 |
| Expert | .25 | 1.00 |

The purpose is to make the system more difficult (unpredictable) as the skill of the primary shooter 14 increases. Also, the difficulty of angle 46 of clay bird 24 flight, random selection process and throwers 18 or 26 available will increase as primary shooter 14 skill level increases. An example of this information is shown in Tables 1 and 2. With this data on available angles 46 of clay bird 24 flight and available throwers 18 to be used at that specific shooter station 22. The microprocessor 4 can randomly determine where to place the clay bird 24 thrower 18 or 26 and which clay bird 24 throwers 18 or 26 can throw clay birds 24 within above constraints. The angular reference 98 and specific thrower designations 100, 102, 104, 106, 108, 110 are shown in FIGS. 17, 18 and 19.

TABLE 1

Throwers available and range of clay bird flight angle 46 for first shooter station 22 of FIG. 17.

| Skill Level | Available Clay Bird Thrower | Range of Available Angle |
|---|---|---|
| Beginner | 1 (designation 100) | 090 to 135 degrees |
| | 2 (designation 102) | 235 to 280 degrees |
| | 3 (designation 104) | 045 to 080 degrees |
| Intermediate | 1 (designation 100) | 090 to 145 degrees |
| | 2 (designation 102) | 225 to 290 degrees |
| | 3 (designation 104) | 040 to 090 degrees |
| | 4 (designation 106) | 270 to 315 degrees |
| Expert | 1 (designation 100) | 085 to 180 degrees |
| | 2 (designation 102) | 180 to 295 degrees |
| | 3 (designation 104) | 030 to 145 degrees |
| | 4 (designation 106) | 225 to 325 degrees |

TABLE 2

Throwers available and range of clay bird flight angles 46 for second shooter station 22 of FIG. 18.

| Skill Level | Available Clay Bird Thrower | Range of Available Angle |
|---|---|---|
| Beginner | 1 (designation 100) | 100 to 145 degrees |
| | 2 (designation 102) | 225 to 270 degrees |
| | 3 (designation 104) | 055 to 090 degrees |
| Intermediate | 1 (designation 100) | 100 to 155 degrees |
| | 2 (designation 102) | 205 to 270 degrees |
| | 3 (designation 104) | 040 to 090 degrees |
| | 4 (designation 106) | 260 to 305 degrees |
| Expert | 1 (designation 100) | 095 to 270 degrees |
| | 2 (designation 102) | 090 to 270 degrees |
| | 3 (designation 104) | 045 to 165 degrees |
| | 4 (designation 106) | 215 to 310 degrees |

Tables 1 and 2 show that at the beginner skill level there are less automatic clay bird 24 throwers 18 available, the range of angles 46 available for clay bird 24 flight is smaller as compared to the intermediate and expert skill level selections. As the skill level of the primary shooter 14 increases, the number of available throwers 18 increases and the difficulty and range of clay bird 24 flight angles 46 increases.

The specific time delays, thrower selection and angle 46 of clay bird 24 flight are determined through random number generation within the microprocessor 4. An example of actual system M operation with primary shooter 14 entries and random number generation will be shown later in this "Detailed Description of the Preferred Embodiments".

The primary shooter 14 can also select other parameters that set system M operation. The doubles parameter signals the microprocessor 4 to randomly generate a short (0.10 second) time delay between two successive clay birds 24 thrown. The primary shooter 14 can also enter the type of shotgun to be used, this will give an added time delay for reloading. An example is if the primary shooter 14 enters that a double barrel shotgun is to be used, the microprocessor 4 will give an added 3 second time delay between every one or two clay bird(s) 24 thrown. This added time delay will occur randomly within the microprocessor 4. The added time delay to reload a specific type of shotgun and the doubles routine can run interactively.

A specific example of system operation from shooter station 22 of FIG. 17 will now be described, the primary shooter 14 has selected:

Intermediate skill level mode of operation.

Doubles (Two clay birds 24 thrown with a 0.10 second time delay.)

Pump shotgun (3.0 second time delay needed every 3 or less clay birds 24 thrown.)

Only primary shooter 14 will be using system M.

Shooter selects to shot 50 clay birds 24 (5 clay birds 24 per shooter station 22).

From these parameters the system M operational constraints have been set. These constraints include:

| Skill level | Set time delay (sec) | Variable time delay (sec) |
|---|---|---|
| Intermediate | .50 | .75 |

These time delays will occur between successive clay birds 24 of 0.50 to 1.25 seconds. The mathematical equation for this time delay is:

Total Time Delay=(Set time delay)+((Random number)*(Variable time delay))

Parameters specific to the first shooter station 22 of FIG. 17:

| Skill Level | Available Clay Bird Thrower | Range of Available Angle |
|---|---|---|
| Intermediate | 1 (designation 100) | 090 to 145 degrees |
| | 2 (designation 102) | 225 to 290 degrees |
| | 3 (designation 104) | 040 to 090 degrees |
| | 4 (designation 106) | 270 to 315 degrees |

The random number generator will be seeded by the clock in the microprocessor 4. This random number generator will generate numbers between 0.0000 and 1.0000 every time that it is called. The seeding of the random number generator keeps random numbers from following the same sequence, which specifically makes random numbers as close to random as can be generated from a microprocessor 4.

The primary shooter 14 has entered shooter parameters, now the microprocessor 4 will determine the position of the four microprocessor 4 controlled clay bird 24 throwers 18 that are to be used at the first shooter station. The microprocessor 4 needs to randomly position the microprocessor 4 controlled clay bird 24 throwers 18 within the range of available safe angles 46 for the first shooter station. Since there are four clay bird 24 throwers 18 available at shooter station 22 of FIG. 17, four random numbers need to be generated to position the turntables 96. The four random numbers generated for this example are:

rand(1)=0.1275:rand(2)=0.8863:rand(3)=0.8231:rand(4)=0.4328

The positions determined for the four clay bird 24 throwers 18 are:

position(1)=090+rand(1)*(145–090)=097 degrees position(2)=225+rand(2)*(290–225)=283 degrees position(3)=040+rand(3)*(090–040)=081 degrees position(4)=270+rand(4)*(315–270)=289 degrees The microprocessor 4 will now move the microprocessor 4 controlled turntables 96 to positions calculated. The microprocessor 4 will first read the position of the turntable 96 through the potentiometer 78. The microprocessor 4 will then calculate how many degrees the turntable 96 needs to be moved to achieve Position(n) and in what direction the turntable 96 needs to move. The electric driving motor 52 will move at a known speed (an example is 15 degrees/second). With this information, relay 70 will set desired direction turntable 96 needs to be powered and relay 64 will power the electrical motor for the desired amount of time to achieve the desired position, these relays will be powered by the microprocessor 4 through input/output drives 40. If the turntable 96 needs to be moved 55 degrees counterclockwise, the direction relay 70 would set the proper direction and the power relay 64 would power the turntable 96 for approximately 3.67 seconds. Once all four of the turntables 96 have been set to their desired random angles 46 (position(n)) the microprocessor 4 will await activation of the first shooter station 22 FIG. 17.

The microprocessor 4 will now await the first shooter station 22 activation of FIG. 17. Once the first shooter station 22 has been activated, a determination will be made of which clay bird 24 thrower 18 will throw the first clay bird 24. There are four automatic clay bird 24 throwers 18 (designations 100, 102, 104 and 106) in operation at the first shooter station 22, to randomly select the thrower 18 that will throw the first clay bird 24, a random number will be generated. Each available clay bird 24 thrower 18 will have a equal chance of being selected. This example will show how the first thrower will be selected, a random number will be generated between 0.0000 and 1.0000, if random number (identified by rand(n)) is less than 0.2500, thrower one 100 will be selected. If rand(n) is greater than or equal to 0.2500 and less than 0.5000, thrower two 102 will be selected. If rand(n) is greater than or equal to 0.5000 and less than 0.7500, thrower three 104 will be selected. If rand(n) is greater than or equal to 0.7500 and less than or equal to 1.0000, thrower four 106 will be selected. For this example a rand(n) is generated and its value is 0.3492, thrower two 102 is randomly selected to throw the first clay bird 24.

The time delay will now be determined to throw the first clay bird 24 from clay bird 24 thrower two 102. Another random number is generated and its value is 0.7396, the time delay in the intermediate mode of operation is:

Total Time Delay=(Set time delay)+((Random number)*(Variable time delay))

The time delay for the clay bird 24 to be thrown after shooter station activation 22 is 1.05 seconds since the intermediate mode of operation was selected. The computer allows a time elapse of 1.05 seconds after shooter station activation 22, then throws the first clay bird 24 from thrower two 102.

The primary shooter 14 has selected to shoot 50 clay birds 24 (5 clay birds 24 per station), the system M must go through the random selection procedure and throw the next clay bird 24 with shooter specifications of system M operation in consideration. The main special parameters to keep in consideration that were specified by the primary shooter 14 are intermediate skill level, doubles and pump shotgun. To randomly determine if doubles will be thrown, a random number (rand(n)) will be generated, if this random number us less than 0.5000, doubles will be thrown. Also a rand(n) will be generated to determine if an added time delay will occur to allow the primary shooter 14 to reload his shotgun, if this rand(n) is less than 0.3000, the system M will allow an additional time delay for shotgun reloading. If the random selection chooses added time delay to reload shotgun, this will override the determination of doubles. Also if the computer signifies (through random number generation) either doubles or extended time delay for reloading this will override the standard time delay for the beginner, intermediate or expert level. Specifically, if the microprocessor 4 determines through rand(n) generation that both doubles and added time delay to reload shotgun are determined for a specific clay bird 24, the added time delay for reloading will be a priority over the short time delay for doubles. For this example random number for doubles is generated, rand(n)=0.1740, this specifies doubles. Also the random number for reloading is generated, rand(n)=0.8923, so the microprocessor 4 has determined that doubles will be thrown. The thrower 18 will now be determined to throw the second clay bird 24. A random number is generated, rand(n)=0.2311, this selects clay bird 24 thrower one 100. Now 0.10 seconds are allowed to elapse since the first clay bird 24 was thrown for the first shooter station 22, this will occur 1.15 seconds after shooter station 22 activation.

A time delay needs to be randomly determined and the third clay bird 24 needs to be thrown. Since doubles was selected for the second clay bird 24 thrown from clay bird 24 thrower one 100, the doubles routine cannot be used twice in a row. The doubles routine cannot be used for the third clay bird 24 from the first shooter station 22. A random number is generated to determine if extended time delay for reloading will be randomly selected, rand(n)=0.4599, since this is not less than 0.3000, the additional time delay for shotgun reloading will not be selected. Since doubles and additional time for reloading were not selected, the time delay must be determined for the intermediate skill level. A random number is generated, rand(n)=0.7661, time delay is calculated of 1.07 seconds. The thrower must now be selected, rand(n)=0.8508, this randomly selects clay bird 24 thrower four 106. 1.07 seconds are allowed to elapse after second clay bird 24 was thrown from clay bird 24 thrower one 100, or total elapsed time of 2.22 seconds after shooter station one 22 of FIG. 17 was activated.

Time delay needs to be determined and the fourth clay bird 24 will be thrown. Since three clay birds 24 have been thrown with no additional time delay for reloading, the additional time delay to reload must occur. If the number of clay birds 24 have been thrown that equals the number of shots the shooter has in his shotgun and there has not been an additional time delay for reloading. The additional time delay for reloading will override determination of doubles or skill level time delay (beginner, intermediate and expert). A three second time delay will occur before clay bird 24 four is thrown. A random number will now be generated to determine which clay bird 24 thrower 18 will be randomly selected to throw the fourth clay bird 24, rand(n)=0.6934, this randomly selects clay bird 24 thrower number three 104 with a time delay of 3.00 seconds after the third clay bird 24 was thrown from clay bird 24 thrower number four 106. This will occur 5.22 seconds after the activation of shooter station 22 one of FIG. 17.

Time delay needs to be determined and the fifth clay bird 24 will be thrown. Random numbers will be generated to determine if doubles or extended time delay for reloading will occur. rand(n)=0.6537, the doubles routine will not be selected. rand(n)=0.5188, the extended time delay to allow the primary shooter 14 to reload the shotgun will not be selected. The time delay must then be determined for the intermediate skill level selection, rand(n)=0.4526, the time delay will be 0.84 seconds. The random number generation will occur to determine which clay bird 24 thrower 18 will be used to throw the fifth clay bird 24, rand(n)=0.0328. A time delay of 0.84 seconds will occur and then the fifth clay bird 24 will be thrown from clay bird 24 thrower one 100. This will occur after the throwing of the fourth clay bird 24 from clay bird 24 thrower three 104. This will be a total elapsed time of 6.06 seconds after shooter station 22 one activation of FIG. 17. A Table of the throwing of clay birds 24 for the first shooter station 22 with the previously described shooter specified parameters will be shown in Table 3.

TABLE 3

System M operation from the first shooter station 22 of FIG. 17.

| Time delay (total) | Thrower selected | Time delay routine | Explanation |
|---|---|---|---|
| 1.05 seconds | two | Intermediate | none |
| 1.15 seconds | one | Doubles | none |
| 2.22 seconds | four | Intermediate | none |
| 5.22 seconds | three | Shotgun reload | Reload a priority |
| 6.06 seconds | one | Intermediate | none |

Once the system M is finished throwing the designated number of clay birds 24 for the first shooter station 22 of FIG. 17. The microprocessor 4 will then randomly set the position 46 of the clay bird 24 throwers 18 for the second shooter station number 22 of FIG. 18. The range of safe angles 46 to position the clay bird 24 throwers 18 for the second shooter station 22 of FIG. 18 is shown in Table 2. The procedure of determining the random positioning of the turntables 96 will occur in the same way as for the first shooter station 22 of FIG. 17 described earlier. The system M will operate in the same way as it did for the first shooter station 22 of FIG. 17 for all shooter stations 12 within the system.

The procedure will occur in this manner, previous station (n–1) has thrown allotted amount of clay birds 24 or system parameters 2 are entered into the microprocessor 4. Microprocessor 4 randomly determines thrower positioning (angle) 46 of each thrower 18 dependent on skill levels 2 entered by the primary shooter 14 and which shooter station 22 the primary shooter 14 will be shooting. An example of the range of angles 46 are shown in Tables 1 and 2, for shooter stations one and two respectively. Once the system M has set the turntables 96 it then awaits the activation of the shooter station 22. Once the shooter station 22 is activated, time delays are determine to throw specific clay bird 24. This time delay is dependent on which primary shooter 14 specified routines were selected (beginner, intermediate or expert) and which special parameters of operation were selected (doubles, type of shotgun, additional shooters 16). Also selection of clay bird 24 throwers 18 are determined by randomly choosing from available clay bird 24 throwers 18, an example of available clay bird 24 throwers 18 are in Tables 1 and 2. Once all clay birds 24 have been thrown for that specific shooter station 22, the microprocessor 4 will randomly set the throwers for the next station 12 as described in the top of this paragraph. This continues until all shooter stations 22 have been activated and the primary shooter 14 is done shooting at all the clay birds 24 to be thrown by the system M for that specific system M operation.

The system M then awaits next shooter to enter primary shooter 14 parameters. The system M will then randomly set the angle 46 of the available clay bird 24 throwers 18 for that specific shooter station 22 dependent on the level of skill entered by the primary shooter 14. System M awaits shooter station activation 22, thrower selection and time delays are randomly determined, clay birds 24 are thrown.

The previous description of system M operation shows how the random number generation adds randomness to system M operation. This randomness in combined with primary shooter 14 specified parameters 2, makes the system M unpredictable.

A detailed drawing of an automatic loading and throwing clay bird 24 thrower 94 on top of a microprocessor 4 controlled turntable 96 is shown in FIG. 13. The combination of 94 and 96 are a microprocessor 4 controlled automatic loading and throwing clay bird 24 thrower, designation 18. The main embodiments of FIG. 13 are an automatic loading and throwing clay bird 24 thrower 94 positioned on top of a microprocessor controlled turntable 96. This turntable is controlled and monitored through input/output 40 drives. The microprocessor 4 communicates through control lines 20 to control lines 60. Control lines 60 connect to electrical box 50 (FIG. 15) which house all components necessary to drive and monitor turntable 96. Control line 60 is also connected to position monitoring device 78 (FIG. 16), which reads the angular position 98 of automatic clay bird thrower on turntable 18. With the described automatic clay bird 24 thrower and turntable 18 the microprocessor 4 is capable of controlling and monitoring the position of automatic clay bird 24 thrower on turntable 18.

The microprocessor 4 is capable of accepting primary shooter 14 entries 2. These primary shooter 14 entries 2 allow the primary shooter 14 to set difficulty levels of the system M. FIGS. 17 and 18 will show microprocessor 4 operation with user specified parameters (limits) and the generation of random numbers to vary the setting of the system M within shooter specified parameters 2. The purpose of using random numbers to alter system M operation within limits 2 is to have varying system M operation, which makes system M unpredictable, challenging and exciting.

The microprocessor 4 controlled clay bird 24 thrower on turntable 18 shown in detail in FIG. 13 is also shown in less detail in FIG. 19. FIG. 19 shows the orientation 46 of automatic thrower and turntable 18. The direction of clay bird 24 flight 46 for this FIG. 19 is approximately 215 degrees. A scaling of degree markers 98 is shown on FIGS. 17–19. FIGS. 17 and 18 show the system M with throwers 18 from FIG. 19. These Figures show direction of clay bird 24 flight 46 from each thrower with degree markings 98.

The microprocessor controlled clay bird 24 thrower on turntable 18 is monitored for position of turntable 18 by a potentiometer 78. The components of the potentiometer 78 are shown in detail in FIG. 16. The purpose of the potentiometer 78 is a means by which the microprocessor 4 can determine the orientation (angle) 46 of the clay bird 24 thrower 18. The microprocessor 4 can determine the position 46 of the turntable 18 with other types of position monitoring devices 78. The microprocessors 4 ability to monitor the position 46 is not limited to the use of a potentiometer 78, but is made to include any device by which the microprocessor 4 can determine the position of the turntable 18.

The microprocessor 4 controls the direction and powering of the turntable 18 through a system of relays 64 and 70 connected to a reversible electric motor 52 (this is all shown in FIG. 15). The electric motor 52 is reversed by changing the current flow through either the rotor or stator (starting coil) 74 and 76. The reversing of the electric motor can be done easily through a DPDT relay 64, a latching (DPDT) relay can also be used. The microprocessor 4 through input/output 40 drives sets the direction of the motor through relay 64 then powers the system (relay 70) to achieve the desired position 46 of the turntable 18. FIG. 15 shows the detailed wiring of the proper circuit to power (move) the turntable 18 in two directions with the microprocessor 4.

The activation of the shooter stations 22 by the primary shooter 14 can be achieved with many devices. The simplest of devices could be a SPDT switch which the primary shooter 14 activates when in position to shoot. This SPDT switch sends a signal to the microprocessor 4 that the primary shooter 14 has activated shooter station More complex devices could include proximity switches, breaking light beam and Polaroid cells. All these devices have the capacity to monitor the primary shooter 14 and activate the microprocessor 4 through software and hardware. Specifically, shooter station activation 22 can be any device in which the microprocessor 4 can determine the primary shooter 14 has activated that specific shooter station 22.

Thus, there has been illustrated and described a unique and novel clay bird shooting system, which a shooter(s) engage a plurality of clay bird targets that are randomly thrown from a plurality of clay bird throwers controlled and monitored by a microprocessor. The primary shooter can specify skill levels and other parameters which set limits on system operation dependent on the primary shooters skills. It should be understood that many changes, modifications, variations and other uses and applications of this microprocessor controlled clay bird shooting system will become apparent to those skilled in the art after considering this specification and the accompanying drawings. Therefore, any and all such changes, modifications, variations and other uses and applications which do not depart from the nature and spirit of the invention are deemed to be covered by the invention which is limited only by the following claims.

Having thus described my invention, what I desire to claim and secure by Letters Patent is:

1. A target system for a shooter, comprising:

a microprocessor, including means for a shooter to input data thereto;

means to establish a predetermined shooting path for a shooter to move along, said shooting path having a plurality of shooter stations and means to sense the shooter along said shooting path and to input the shooter station sensed to said microprocessor; and a plurality of target throwers connected to said microprocessor and disposed on both sides of said predetermined shooting path, said target throwers randomly directing targets for the shooter in response to output from said microprocessor based upon input from the shooter and the sensed shooter station of the shooter.

2. The target system of claim 1, wherein said plurality of target throwers are clay bird throwers.

3. The target system of claim 1, wherein the predetermined shooting path is a straight line.

4. The target system of claim 1, wherein the predetermined shooting path is a zig-zag line.

5. The target system of claim 2, wherein said clay bird throwers have controllable vertical and horizontal angles of clay bird flight.

6. The target system of claim 1, wherein the shooter inputs to the microprocessor set variable time delays between targets thrown.

7. The target system of claim 6, wherein the shooter inputs to microprocessor set degree of difficulty of time delays.

8. The target system of claim 6, wherein the shooter inputs to the microprocessor set difficulty of angle thrown of clay bird.

9. The target system of claim 6, wherein the shooter inputs to the microprocessor include special parameters for what type of shotgun will be used for microprocessor to give enough time between sets of clay birds thrown for reloading shotgun.

10. The target system of claim 6, wherein the shooter inputs to the microprocessor include special parameters for doubles, or the throwing of a plurality of clay birds with a short time delay.

11. The target system of claim 6, wherein the shooter inputs to the microprocessor include special parameters for a plurality of shooters on predetermined plurality of shooter paths.

12. A microprocessor based target system for a shooter, comprising:

means for the shooter to input data to the microprocessor;

means to establish a predetermined shooting path for the shooter to move along, said path having a plurality of shooter stations and means to sense the shooter along said predetermined shooting path and to input the shooter station sensed to said microprocessor; and a plurality of target throwers connected to said microprocessor and disposed on at least one side of said predetermined shooting path, the microprocessor generating random signals to said plurality of target throwers based upon input from the shooter and from said sensed shooter station.

13. The microprocessor based target system of claim 12, wherein said microprocessor generates random signals within shooter specified input parameters and wherein microprocessor checks system operation within shooter specified input parameters for proper operation of system.

14. The microprocessor based target system of claim 13, wherein system operates within shooter specified input parameters for proper operation and wherein microprocessor readjusts or shuts down any said target throwers if not within shooter specified parameters.

15. A target system for a shooter, comprising:

a microprocessor, including means for the shooter to input data thereto;

means to establish a primary shooting path for a primary shooter including means to sense the primary shooter along said primary shooting path having a plurality of shooter stations and input the shooter station sensed to said microprocessor;

a first plurality of target throwers connected to said microprocessor and disposed on both sides of said primary shooting path, said target throwers randomly directing targets for the primary shooter in response to output from said microprocessor based upon input from the primary shooter and the sensed shooter station of the primary shooter on the primary shooting path;

means to establish a secondary shooting path for a secondary shooter including means to sense the secondary shooter along said secondary shooting path having a plurality of shooter stations and input the shooter station sensed to said microprocessor;

a second plurality of target throwers connected to said microprocessor and disposed on both sides of said secondary shooting path, said target throwers randomly directing targets for the secondary shooter in response to output from said microprocessor based upon input from the secondary shooter and the sensed shooter station of the secondary shooter; and said microprocessor including means to prevent interference between the primary shooter and the secondary shooter.

16. The target system of claim 15, wherein said microprocessor directs said target throwers to randomly throw targets wherein the primary and secondary shooters can engage all targets and not have any shooter in line of fire.

17. The target system of claim 15, wherein said microprocessor directs said target throwers to randomly throw targets wherein the primary and secondary shooters will not be in path of thrown targets.

18. The target system of claim 15, wherein said microprocessor directs said target throwers to randomly throw targets wherein the primary and secondary shooters can engage all targets and not have any person or property in line of fire.

19. The target system of claim 15, wherein said microprocessor includes special parameters for the type of shotgun for each shooter.

20. The target system of claim 15, wherein said microprocessor will shut down any of said first or second plurality of target throwers not within shooter specified parameters.

21. A microprocessor based target system for a shooter, comprising:

means for the shooter to input data to the microprocessor;

means to establish a primary shooting path for a primary shooter, said primary shooting path having a plurality of shooter stations and including means to sense the primary shooter along said primary shooting path and input the shooter station sensed to said microprocessor;

a first plurality of target throwers connected to said microprocessor and disposed on at least one side of said primary shooting path, said target throwers randomly directing targets for the primary shooter in response to output from said microprocessor based upon input from the primary shooter and the sensed shooter station of the primary shooter on the primary shooting path;

means to establish a secondary shooting path for a secondary shooter, said secondary shooting path having a plurality of shooter stations and including means to sense the secondary shooter along said secondary shooting path and input the shooter station sensed to said microprocessor;

a second plurality of target throwers connected to said microprocessor and disposed on at least one side of said secondary shooting path, said target throwers randomly directing targets for the secondary shooter in response to output from said microprocessor based upon input from the secondary shooter and the sensed shooter station of the secondary shooter; and said microprocessor including means to prevent interference between the primary shooter and the secondary shooter.

22. A target system for a shooter, comprising:

a microprocessor, including means for a shooter to input data thereto;

means to establish a shooting path for a shooter to move along, said shooting path having a plurality of shooter stations;

means to sense the shooter along said path and to input the shooter station sensed to said microprocessor; and a plurality of target throwers connected to said microprocessor and disposed on at least one side of said shooting path, said target throwers randomly directing targets for the shooter in response to output from said microprocessor based upon input from the shooter and the sensed shooter station of the shooter.

* * * * *